US010905923B2

(12) United States Patent
Bovee et al.

(10) Patent No.: US 10,905,923 B2
(45) **Date of Patent: *Feb. 2, 2021**

(54) GOLF CLUB HEAD

(71) Applicant: Taylor Made Golf Company, Inc., Carlsbad, CA (US)

(72) Inventors: Mattieu Bovee, Carlsbad, CA (US); Brian Bazzel, Carlsbad, CA (US); Todd Beach, San Diego, CA (US); Stephen Kraus, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/673,060

(22) Filed: Nov. 4, 2019

(65) Prior Publication Data

US 2020/0061427 A1 Feb. 27, 2020

Related U.S. Application Data

(63) Continuation of application No. 15/370,530, filed on Dec. 6, 2016, now Pat. No. 10,463,927.

(51) Int. Cl.

| | |
|---|---|
| ***A63B 53/04*** | (2015.01) |
| ***A63B 53/02*** | (2015.01) |
| ***A63B 53/06*** | (2015.01) |

(52) U.S. Cl.

CPC ..... *A63B 53/0466* (2013.01); *A63B 53/02* (2013.01); *A63B 53/06* (2013.01); *A63B 53/025* (2020.08); *A63B 53/026* (2020.08); *A63B 53/0408* (2020.08); *A63B 53/0433* (2020.08); *A63B 53/0437* (2020.08); *A63B 2053/0491* (2013.01)

(58) Field of Classification Search

CPC ..... A63B 53/0466; A63B 53/02; A63B 53/06; A63B 53/025; A63B 53/026; A63B 53/0408; A63B 53/0433; A63B 53/0437; A63B 2053/0491

See application file for complete search history.

(56) References Cited

U.S. PATENT DOCUMENTS

| | | | |
|---|---|---|---|
| 5,362,055 | A | 11/1994 | Rennie |
| 5,776,011 | A | 7/1998 | Su et al. |
| 6,001,027 | A | 12/1999 | Hansberger |
| 6,089,070 | A | 7/2000 | Hancock et al. |
| 6,354,963 | B1 | 3/2002 | Kodama et al. |
| 6,565,452 | B2 | 5/2003 | Helmstetter et al. |
| 6,575,845 | B2 | 6/2003 | Galloway et al. |

(Continued)

FOREIGN PATENT DOCUMENTS

| | | | |
|---|---|---|---|
| JP | 2005-52458 | A | 3/2005 |
| JP | 3762906 | B2 | 4/2006 |

(Continued)

*Primary Examiner* — Stephen L Blau

(74) *Attorney, Agent, or Firm* — Sterne, Kessler, Goldstein & Fox P.L.L.C.

(57) ABSTRACT

A golf club head including a crown defining the top surface of the club head and including a crown portion, a crown recess region formed in the crown portion and defined by a crown ledge and a bonding wall, and a crown insert disposed at least partially within the crown recess region. The size and uniformity of the junction between the crown insert and the bonding wall may be determined by measuring the dimensions of the junction at critical points on the club head.

20 Claims, 21 Drawing Sheets

(56) References Cited

U.S. PATENT DOCUMENTS

| | | | |
|---|---|---|---|
| 6,623,378 | B2 | 9/2003 | Beach et al. |
| 6,663,503 | B1 | 12/2003 | Kenmi |
| 6,872,152 | B2 | 3/2005 | Beach et al. |
| 6,881,159 | B2 | 4/2005 | Galloway et al. |
| 6,932,719 | B2 | 8/2005 | Yabu |
| 6,955,612 | B2 | 10/2005 | Lu |
| 6,969,326 | B2 | 11/2005 | Shiell et al. |
| 7,041,005 | B2 | 5/2006 | Beach et al. |
| 7,066,835 | B2 | 6/2006 | Evans et al. |
| 7,128,661 | B2 | 10/2006 | Soracco et al. |
| 7,189,165 | B2 | 3/2007 | Yamamoto |
| 7,258,625 | B2 | 8/2007 | Kawaguchi et al. |
| 7,258,630 | B2 | 8/2007 | Erickson et al. |
| 7,261,645 | B2 | 8/2007 | Oyama |
| 7,261,646 | B2 | 8/2007 | Shiell et al. |
| 7,273,419 | B2 | 9/2007 | Evans et al. |
| 7,281,994 | B2 | 10/2007 | Shiell et al. |
| 7,297,074 | B2 | 11/2007 | Kumamoto |
| 7,303,487 | B2 | 12/2007 | Kumamoto |
| 7,311,614 | B2 | 12/2007 | Kumamoto |
| 7,314,067 | B2 | 1/2008 | Lindsay |
| 7,402,113 | B2 | 7/2008 | Mori et al. |
| 7,407,447 | B2 | 8/2008 | Beach et al. |
| 7,435,190 | B2 | 10/2008 | Sugimoto |
| 7,438,647 | B1 | 10/2008 | Hocknell |
| 7,455,600 | B2 | 11/2008 | Imamoto et al. |
| 7,468,005 | B2 | 12/2008 | Kuono et al. |
| 7,491,134 | B2 | 2/2009 | Murphy et al. |
| 7,494,425 | B2 | 2/2009 | Shiell et al. |
| 7,497,787 | B2 | 3/2009 | Murphy et al. |
| 7,500,925 | B2 | 3/2009 | Mori et al. |
| 7,530,901 | B2 | 5/2009 | Imamoto et al. |
| 7,530,903 | B2 | 5/2009 | Imamoto et al. |
| 7,549,933 | B2 | 6/2009 | Kumamoto |
| 7,563,178 | B2 | 7/2009 | Rae et al. |
| 7,585,233 | B2 | 9/2009 | Horacek et al. |
| 7,658,686 | B2 | 2/2010 | Soracco |
| 7,691,008 | B2 | 4/2010 | Oyama |
| 7,699,719 | B2 | 4/2010 | Sugimoto |
| 7,704,164 | B2 | 4/2010 | Beach et al. |
| 7,713,138 | B2 | 5/2010 | Sato et al. |
| 7,749,103 | B2 | 7/2010 | Nakano |
| 7,775,903 | B2 | 8/2010 | Kawaguchi et al. |
| 7,874,936 | B2 | 1/2011 | Chao |
| 7,938,740 | B2 | 5/2011 | Breier et al. |
| 7,959,523 | B2 | 6/2011 | Rae et al. |
| 7,993,216 | B2 | 8/2011 | Lee |
| 8,038,545 | B2 | 10/2011 | Soracco |
| 8,062,151 | B2 | 11/2011 | Boyd et al. |
| 8,147,350 | B2 | 4/2012 | Beach et al. |
| 8,187,119 | B2 | 5/2012 | Rae et al. |
| 8,192,303 | B2 | 6/2012 | Ban |
| 8,216,087 | B2 | 7/2012 | Breier et al. |
| 8,226,499 | B2 | 7/2012 | Soracco |
| 8,257,196 | B1 | 9/2012 | Abbott et al. |
| 8,298,096 | B2 | 10/2012 | Sites et al. |
| 8,303,431 | B2 | 11/2012 | Beach et al. |
| 8,425,827 | B2 | 4/2013 | Lee |
| 8,435,134 | B2 | 5/2013 | Tang et al. |
| 8,460,123 | B1 | 6/2013 | Demille et al. |
| 8,485,920 | B2 | 7/2013 | Breier et al. |
| 8,523,705 | B2 | 9/2013 | Breier et al. |
| 8,529,370 | B1 | 9/2013 | Galloway et al. |
| 8,579,726 | B2 | 11/2013 | Beach et al. |
| 8,696,491 | B1 | 4/2014 | Myers |
| 8,740,719 | B2 | 6/2014 | Wahl et al. |
| 8,753,224 | B1 | 6/2014 | Kim |
| 8,771,097 | B2 | 7/2014 | Bennett et al. |
| 8,777,776 | B2 | 7/2014 | Wahl et al. |
| D711,993 | S | 8/2014 | Miraflor et al. |
| 8,795,101 | B2 | 8/2014 | Nishio |
| 8,849,437 | B2 | 9/2014 | Chow et al. |
| 8,870,679 | B2 | 10/2014 | Oldknow |
| 8,926,450 | B2 | 1/2015 | Takahashi et al. |
| 9,174,098 | B2 | 11/2015 | Hayase et al. |
| 9,504,889 | B2 | 11/2016 | Mitzel et al. |
| 9,579,549 | B2 | 2/2017 | Beach et al. |
| 2003/0125127 | A1 | 7/2003 | Nakahara et al. |
| 2003/0134691 | A1 | 7/2003 | Tinney |
| 2004/0116207 | A1 | 6/2004 | Shiell et al. |
| 2005/0026723 | A1 | 2/2005 | Kumamoto |
| 2006/0058115 | A1 | 3/2006 | Erickson et al. |
| 2007/0060413 | A1 | 3/2007 | Beach et al. |
| 2008/0139334 | A1 | 6/2008 | Willett et al. |
| 2009/0293259 | A1 | 12/2009 | Rice |
| 2012/0125073 | A1 | 5/2012 | Hirano |
| 2013/0178306 | A1 | 7/2013 | Beno et al. |
| 2014/0113742 | A1 | 4/2014 | Zimmerman et al. |
| 2015/0031468 | A1 | 1/2015 | Matsunaga et al. |
| 2016/0001146 | A1 | 1/2016 | Sargent et al. |
| 2017/0128793 | A1 | 5/2017 | Beach et al. |

FOREIGN PATENT DOCUMENTS

| | | | |
|---|---|---|---|
| JP | 3823085 | B2 | 9/2006 |
| JP | 4097666 | B2 | 6/2008 |
| JP | 4120990 | B2 | 7/2008 |
| JP | 4256254 | B2 | 4/2009 |
| JP | 2009-148615 | | 7/2009 |
| JP | 4335064 | B2 | 9/2009 |
| JP | 4388411 | B2 | 12/2009 |
| JP | 4403084 | B2 | 1/2010 |
| JP | 4410594 | B2 | 2/2010 |
| JP | 4410606 | B2 | 2/2010 |
| JP | 4441462 | B2 | 3/2010 |
| JP | 4612526 | B2 | 1/2011 |
| JP | 4634828 | B2 | 2/2011 |
| JP | 4651442 | B2 | 3/2011 |
| JP | 4871006 | B2 | 2/2012 |
| JP | 2012-110429 | A | 6/2012 |
| JP | 5324992 | B2 | 10/2013 |
| JP | 5401798 | B2 | 1/2014 |
| JP | 5542147 | B2 | 7/2014 |

GOLF CLUB HEAD

CROSS-REFERENCE TO RELATED APPLICATIONS

This application is a continuation of U.S. application Ser. No. 15/370,530, filed on Dec. 6, 2016, which is incorporated herein in its entirety by reference thereto.

BACKGROUND

Field

The present disclosure relates to a golf club head. More specifically, the present disclosure relates to a golf club head, such as a wood-type golf club head, having a lightweight crown construction.

Background

A wood-type golf club head includes a load-bearing outer shell with an integral or attached strike plate. Some club heads are formed of metal material and have a hollow cavity. The metal body may comprise several portions welded together or may include a cast body with a separate sole plate or strike plate that is welded in the appropriate location.

Most club heads today are made of a strong, yet lightweight metal material such as, for example, a titanium, steel or aluminum alloy. There have also been heads formed of carbon fiber composite material. The use of these materials is advantageous for the larger club heads now sought by golfers, i.e., at least 300 cc and up to about 500 cc in volume. The larger sized, yet conventionally weighted, club heads strive to provide larger "sweet spots" on the striking face and club moments of inertia that, for some golfers, make it easier to get a golf ball up in the air and with greater accuracy.

Titanium alloys are particularly favored in club head designs for their combination of strength and light weight. However, the material can be quite costly. Steel alloys are more economical; however, since the density of steel alloys is greater than for titanium alloys, steel club heads are limited in size in order to remain within conventional head weights while maintaining durability.

Composite club heads, such as a carbon fiber reinforced epoxy or carbon fiber reinforced polymer, for example, are an alternative to metal club heads. A notable advantage is the relatively light weight compared to stainless steel alloys. However, these club heads have suffered from durability and performance qualities associated with composite materials. These include higher labor costs in manufacture, undesirable acoustic properties of the composite material.

A lightweight and durable golf club head that can be manufactured using a cost effective process may be desirable. Therefore, there is a continuing need for innovations in construction and manufacturing of golf club heads. Embodiments discussed herein fulfill this need and others.

BRIEF SUMMARY OF THE INVENTION

The present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures.

Some embodiments are direct towards a golf club including a grip, a golf club shaft, a golf club head having a hosel portion, a crown, and a sole portion, the crown defining the top surface of the club head and including a crown portion that includes a crown recess region formed in the crown portion and defined by a crown ledge and a bonding wall, and a crown insert disposed at least partially within the crown recess region. The golf club also including a width dimension measured along an X-axis from a toe side of the golf club head to the heel side of the golf club head; a depth dimension measured along a Y-axis from a forward most point of the golf club head to a rearward most point of the golf club head; a central Z-axis extending in a vertical direction through the crown at a midpoint of the width dimension and a midpoint of the depth dimension; a central Y-axis intersecting the central Z-axis at the top surface of the club head and extending parallel to the Y-axis; a central X-axis intersecting the central Z-axis at the top surface of the club head and extending parallel to the X-axis; a first vertical plane defined by the central Z axis and the central Y-axis; a second vertical plane defined by rotating the first vertical plane 30 degrees clockwise about the central Z-axis; a third vertical plane defined by rotating the first vertical plane 30 degrees counter-clockwise about the central Z-axis; a fourth vertical plane defined by the central Z-axis and the central X-axis; a fifth vertical plane defined by rotating the fourth vertical plane 30 degrees clockwise about the central Z-axis; a sixth vertical plane defined by rotating the fourth vertical plane 30 degrees counter-clockwise about the central Z-axis; an X-Y plane defined by the central Y-axis and the central X-axis; a first critical point located on a front portion of the club head at the intersection between the first vertical plane and a top edge of the bonding wall, and a first cross-section taken on a vertical plane perpendicular to the bonding wall at the first critical point; a second critical point located on the front portion of the club head at the intersection between the second vertical plane and the top edge of the bonding wall, and a second cross-section taken on a vertical plane perpendicular to the bonding wall at the second critical point; a third critical point located on the front portion of the club head at the intersection between the third vertical plane and the top edge of the bonding wall, and a third cross-section taken on a vertical plane perpendicular to the bonding wall at the third critical point; a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point. Each cross-section having a first critical dimension defining a bond gap between the crown insert and the bonding wall and measured parallel to the X-Y plane between the top edge of the bonding wall and a top perimeter edge of the crown insert, where the first critical dimension of each cross-section is no more than A mm, and where the average variation of the first critical dimensions between two or more of the cross-sections is no more than 0.2 mm.

In some embodiments, A may be 1.0 mm. In some embodiments, the average variation of the first critical dimensions between the two or more cross-sections is no more than 0.15 mm. In some embodiments, the average variation of the first critical dimensions between the two or more cross-sections is between 0.1 mm and 0 mm.

In some embodiments, a portion of the crown insert and a portion of the crown portion may be contrasting colors. In some embodiments, the crown insert may include an upper layer that extends to the top perimeter edge of the crown insert and is visible at the top perimeter edge of the crown insert located in the front portion of the golf club head. In some embodiments, the bond gap may be visible and not covered by a masking layer.

In some embodiments, the golf club may include a sole recess region formed in the sole portion and defined by a sole ledge and a bonding wall, and a sole insert disposed at least partially within the sole recess region.

In some embodiments, each cross-section may have a second critical dimension measured parallel to the X-Y plane between the bonding wall and a bottom perimeter edge of the crown insert, the second critical dimension of each cross-section may be no more than B mm, and the average variation of the second critical dimensions between two or more of the cross-sections may be no more than 0.2 mm. In some embodiments, B may be 1.0 mm.

In some embodiments, the average variation of the second critical dimensions between the two or more cross-sections is no more than 0.15 mm. In some embodiments, the average variation of the second critical dimensions between the two or more cross-sections is between 0.2 mm and 0 mm.

In some embodiments, at least a portion of the top surface of the crown insert at the top perimeter edge of the crown insert may be disposed below a top surface of the crown portion at the bonding wall. In some embodiments, at least a portion of the top surface of the crown insert at the top perimeter edge of the crown insert may be disposed below the top surface of the crown portion at the bonding wall by a vertical distance between 0.1 mm to 0.3 mm.

In some embodiments, the hosel portion may be configured to receive a sleeve attached to the golf club shaft, the sleeve being capable of being positioned to adjust the loft, lie, or face angle of the golf club head.

In some embodiments, the crown ledge may include a ledge surface defining a ledge gap between the ledge surface and the crown insert and the ledge gap may be no more than 0.3 mm.

In some embodiments, the thickness of the crown insert may be no greater than 1 mm.

In some embodiments, the golf club may include a sixth critical point located on a toe portion of the club head at the intersection between the fourth vertical plane and the top edge of the bonding wall, and a sixth cross-section taken on a vertical plane perpendicular to the bonding wall at the sixth critical point; and a seventh critical point located on a heel portion of the club head at the intersection between the fourth vertical plane and the top edge of the bonding wall, and a seventh cross-section take on a vertical plane perpendicular to the bonding wall at the seventh critical point.

In some embodiments, the golf club head may include a movable weight configured to be moved from a first position to a second position in the golf club head.

Some embodiments are directed towards a golf club head including a crown defining the top surface of the club head, the crown including a crown portion, a crown recess region formed in the crown portion and defined by a crown ledge and a bonding wall, and a crown insert disposed at least partially within the crown recess region. The golf club head also including a width dimension measured along an X-axis from a toe side of the golf club head to the heel side of the golf club head; a depth dimension measured along a Y-axis from a forward most point of the golf club head to a rearward most point of the golf club head; a central Z-axis extending in a vertical direction through the crown at a midpoint of the width dimension and a midpoint of the depth dimension; a central Y-axis intersecting the central Z-axis at the top surface of the club head and extending parallel to the Y-axis; a central X-axis intersecting the central Z-axis at the top surface of the club head and extending parallel to the X-axis; a first vertical plane defined by the central Z axis and the central Y-axis; a second vertical plane defined by rotating the first vertical plane θ degrees clockwise about the central Z-axis; a third vertical plane defined by rotating the first vertical plane θ degrees counter-clockwise about the central Z-axis; a fourth vertical plane defined by the central Z-axis and the central X-axis; a fifth vertical plane defined by rotating the fourth vertical plane β degrees clockwise about the central Z-axis; a sixth vertical plane defined by rotating the fourth vertical plane β degrees counter-clockwise about the central Z-axis; an X-Y plane defined by the central Y-axis and the central X-axis; a first critical point located on a front portion of the club head at the intersection between the first vertical plane and a top edge of the bonding wall, and a first cross-section taken on a vertical plane perpendicular to the bonding wall at the first critical point; a second critical point located on the front portion of the club head at the intersection between the second vertical plane and the top edge of the bonding wall, and a second cross-section taken on a vertical plane perpendicular to the bonding wall at the second critical point; a third critical point located on the front portion of the club head at the intersection between the third vertical plane and the top edge of the bonding wall, and a third cross-section taken on a vertical plane perpendicular to the bonding wall at the third critical point; a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point. Each cross-section having a first critical dimension defining a bond gap between the crown insert and the bonding wall and measured parallel to the X-Y plane between the top edge of the bonding wall and a top perimeter edge of the crown insert, where the first critical dimension of each cross-section is no more than A mm, the average variation of the first critical dimensions between seven or more of the cross-sections is no more than 0.15 mm, θ is the range of 1 degree to 45 degrees, and β is the range of 1 degree to 44 degrees.

In some embodiments, A may be 1.0 mm and θ and β may be 30 degrees.

Some embodiments are directed towards a golf club head including a hosel portion, a crown and a sole portion, the crown defining the top surface of the club head and including a crown portion that includes a crown recess region formed in the crown portion and defined by a crown ledge and a bonding wall, and a crown insert disposed at least partially within the crown recess region. The golf club head also including a width dimension measured along an X-axis from a toe side of the golf club head to the heel side of the golf club head; a depth dimension measured along a Y-axis from a forward most point of the golf club head to a rearward most point of the golf club head; a central Z-axis extending in a vertical direction through the crown at a midpoint of the width dimension and a midpoint of the depth dimension; a central Y-axis intersecting the central Z-axis at the top surface of the club head and extending parallel to the Y-axis;

a central X-axis intersecting the central Z-axis at the top surface of the club head and extending parallel to the X-axis; a first vertical plane defined by the central Z axis and the central Y-axis; a second vertical plane defined by rotating the first vertical plane 30 degrees clockwise about the central Z-axis; a third vertical plane defined by rotating the first vertical plane 30 degrees counter-clockwise about the central Z-axis; a fourth vertical plane defined by the central Z-axis and the central X-axis; a fifth vertical plane defined by rotating the fourth vertical plane 30 degrees clockwise about the central Z-axis; a sixth vertical plane defined by rotating the fourth vertical plane 30 degrees counter-clockwise about the central Z-axis; an X-Y plane defined by the central Y-axis and the central X-axis; a first critical point located on a front portion of the club head at the intersection between the first vertical plane and a top edge of the bonding wall, and a first cross-section taken on a vertical plane perpendicular to the bonding wall at the first critical point; a second critical point located on the front portion of the club head at the intersection between the second vertical plane and the top edge of the bonding wall, and a second cross-section taken on a vertical plane perpendicular to the bonding wall at the second critical point; a third critical point located on the front portion of the club head at the intersection between the third vertical plane and the top edge of the bonding wall, and a third cross-section taken on a vertical plane perpendicular to the bonding wall at the third critical point; a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point. Each cross-section having a first critical dimension defining a bond gap between the crown insert and the bonding wall and measured parallel to the X-Y plane between the top edge of the bonding wall and a top perimeter edge of the crown insert, where the first critical dimension of each cross-section is no more than A mm and the average variation of the first critical dimensions between five or more cross-sections is no more than 0.2 mm.

In some embodiments, the hosel portion may be configured to receive a sleeve, the sleeve being capable of being positioned to adjust the loft, lie, or face angle of the golf club head and being connected to the golf club head by a mechanical fastener.

In some embodiments, the average variation of the first critical dimensions between the five or more cross-sections may be no more than 0.15 mm.

BRIEF DESCRIPTION OF THE DRAWINGS/FIGURES

The present invention(s) are illustrated by way of example and not limitation in the figures of the accompanying drawings in which like references indicate similar elements.

DETAILED DESCRIPTION OF THE INVENTION

Figure 1A:
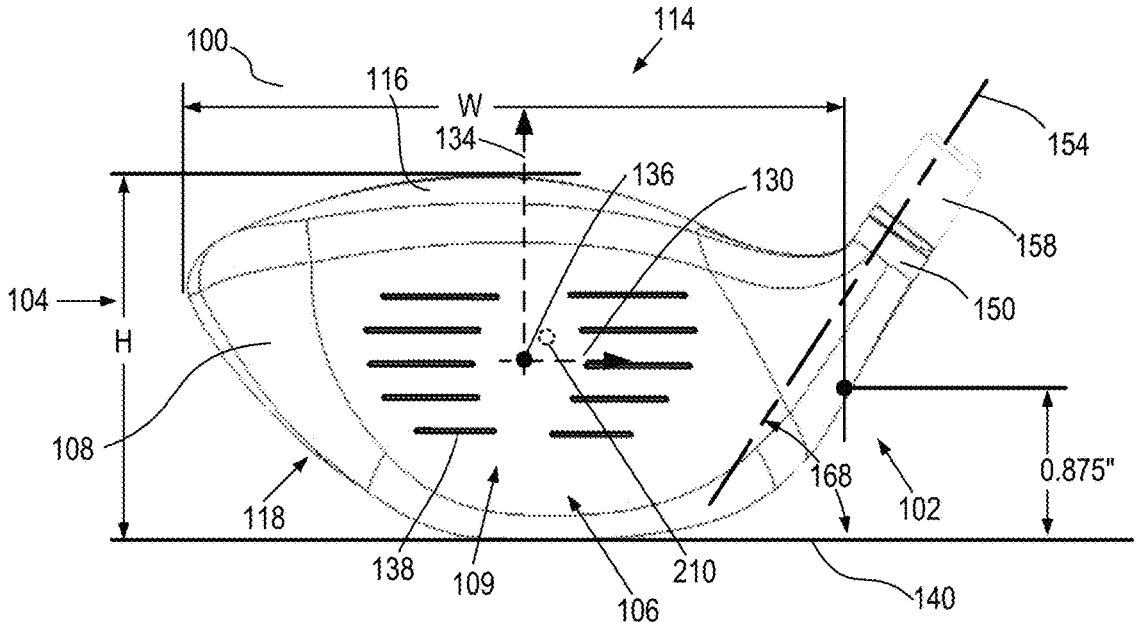
FIG. 1A is a front side view of a golf club head according to some embodiments.

Various embodiments and aspects of the invention(s) will be described with reference to details discussed below. The following description and drawings are illustrative of the invention(s) and are not to be construed as limiting the invention(s). Numerous specific details are described to provide a thorough understanding of various embodiments of the present invention(s). However, in certain instances, well-known or conventional details are not described in order to provide a concise discussion of embodiments of the present invention(s).

A golf club head composed of two or more materials (e.g., a metal material and a composite material) may provide beneficial properties (e.g., weight, sound, size, and center of gravity properties) for a golfer. In some cases, a composite club head may include a metal body and one or more inserts comprising a composite material. For example, a composite material insert may define a portion of a crown of the club head. The composite insert may serve to reduce the weight of a given club head geometry without sacrificing mechanical properties of the club head (e.g., strength and impact performance characteristics) due to the composite material's lightweight and high strength properties.

However, durability at a junction between a two materials (i.e., the location where the first material is bonded to the second material) may be problematic. For example, the durability at a junction between a composite material and a metal material may be problematic. Junctions between a composite material and metal material, often bonded via an adhesive, may be centers of stress concentrations, which may lead to undesirable cracking at these junctions. In order to avoid high amounts of stress concentrations, the junction between the composite material and a metal material should be uniform and consistent. For example, the separation between the composite material and metal material at the junction (e.g., the location of a bonding adhesive) should be uniform and consistent along the junction between the materials. Further, minimizing the amount of separation between the composite and metal materials at the junction may help avoid the formation of cracks because it may reduce the amount of adhesive located at the junction, which may be more susceptible to cracking than the composite and metal materials.

However, while creating uniform, consistent, and and/or minimally sized junctions between a composite material and a metal material may be desirable, the cost of manufacturing such junctions may be a concern. A composite insert that can be separately machined and placed into a recess or cavity on a metal club head body without the need for further machining steps is described herein. Such a process may reduce costs for a manufacturer and/or a consumer of a golf club head and/or golf club.

The uniformity, consistency, and size of a junction between two materials may be characterized by measuring one or more dimensions of the separation between the two materials at the junction. The dimensions of the separation may be measured at specific locations on a club head (i.e., the critical points discussed herein) to determine the uniformity, consistency, and/or size of the junction between two materials. A club head having junction dimensions tailored to be highly uniform and highly consistent may help avoid the formation of undesirable stress concentrations at the junction between two materials. Undesirable stress concentrations due to non-uniform or inconsistent dimensional tolerances may result in mechanical and/or visual defects (e.g., cracks) on a club head.

FIGS. 1A-1F illustrate a golf club head 100 having a heel side 102, a toe side 104, front side 106 having a club face 108 and a striking face 109, a rear side 110, a top side 114 (also called a crown) having top surface 116, a bottom side 118 (also called a sole or sole portion) having a bottom surface 120, a hosel (also called a hosel portion) 150, a hosel axis 154, a hosel insert 158, and a lie angle 168. Golf club head 100 has a width dimension W, a height dimension H, and a depth dimension D measured when the golf club head is positioned in an address position. The address position for a golf club head is defined as the golf club head in a lie angle of fifty-seven degrees and the loft of the club adjusted to the designated loft of the club head. Unless otherwise stated, all the measured dimensions described herein are evaluated when a golf club head is oriented in the address position. If a golf club head at a fifty-seven degree lie angle visually appears to be unlevel from a front face perspective, an alternative lie angle called the "scoreline lie" may be used. The scoreline lie is defined as the lie angle at which the substantially horizontal face scorelines are parallel to a perfectly flat ground plane.

The width dimension W of golf club head 100 may not be greater than 5 inches, and the depth dimension D of golf club head 100 may not be greater than the width dimension W. The height dimension H of golf club head 100 may not be greater than 2.8 inches. In some embodiments, the depth dimension D or the width dimension W may be greater than 4.4", greater than 4.5", greater than 4.6", greater than 4.7", greater than 4.8", greater than 4.9", or between 4.6" and 5". In some embodiments, the height dimension H may be greater than 2.7", greater than 2.6", greater than 2.5", greater than 2.4", greater than 2.3", greater than 2.2", greater than 2.1", greater than 2", greater than 1.9" or greater than 1.8". In certain embodiments, the height dimension H of golf club head 100 may be between about 63.5 mm to 71 mm (2.5" to 2.8"), the width dimension W may be between about 116.84 mm to about 127 mm (4.6" to 5.0"), and the depth dimension D may be between about 111.76 mm to about 127 mm (4.4" to 5.0").

Dimensions W, D, and H are measured on horizontal lines (axes 230, 240, and 250 shown in FIGS. 3A-3C) between vertical projections of the outermost points of heel side 102 and toe side 104, front side 106 and rear side 110, and top side 114 and bottom side 118, respectively. The outermost point of heel side 102 is defined as the point on the heel that is 0.875" above a horizontal ground plane 140 at the address position. The outermost point on front side may be forward most point 280 and the outermost point on rear side 110 may be rearward most point 282, as shown for example in FIG. 3B. W is measured on X-axis 230. D is measured on Y-axis 240. H is measured on Z-axis 250. X-axis 230 and Y-axis 240 are parallel to ground plane 140 and Z-axis 250 is perpendicular to ground plane 140.

FIG. 1A further illustrates a face center location 136. Face center location 136 is found by utilizing the USGA Procedure for Measuring the Flexibility of a Golf Clubhead, Revision 2.0 published on Mar. 25, 2005, herein incorporated by reference in its entirety. Specifically, face center location 136 is found by utilizing the template method described in section 6.1.4 and Figure 6.1 described in the USGA document mentioned above.

A coordinate system for measuring the CG (center of gravity) location for golf club head 100 is located at face center location 136. In one embodiment, the positive center face X-axis 130 projects toward heel side 102 of club head 100, the positive center face Z-axis 134 projects toward top side 114 of club head 100, and the positive center face Y-axis 132 projects towards rear side 110 of club head 100 parallel to ground plane 140.

In some embodiments, golf club head 100 may have a CG with a CG x-axis coordinate between about −5 mm and about 10 mm, a CG y-axis coordinate between about 15 mm and about 50 mm, and a CG z-axis coordinate between about −10 mm and about 5 mm. In some embodiments, the CG y-axis coordinate may be between about 20 mm and about 50 mm.

In some embodiments, scorelines 138 may be located on striking face 109 of club face 108. In some embodiments, a projected CG location 210 shown on club face 108 is considered the "sweet spot" of golf club head 100. Projected CG location 210 is found by balancing golf club head 100 on a point. Projected CG location 210 is generally projected along a line that is perpendicular to club face 108 of golf club head 100. In some embodiments, projected CG location 210 may be less than 2 mm above face center location 136, less than 1 mm above face center location 136, or up to 1 mm or 2 mm below face center location 136.

Figure 1B:
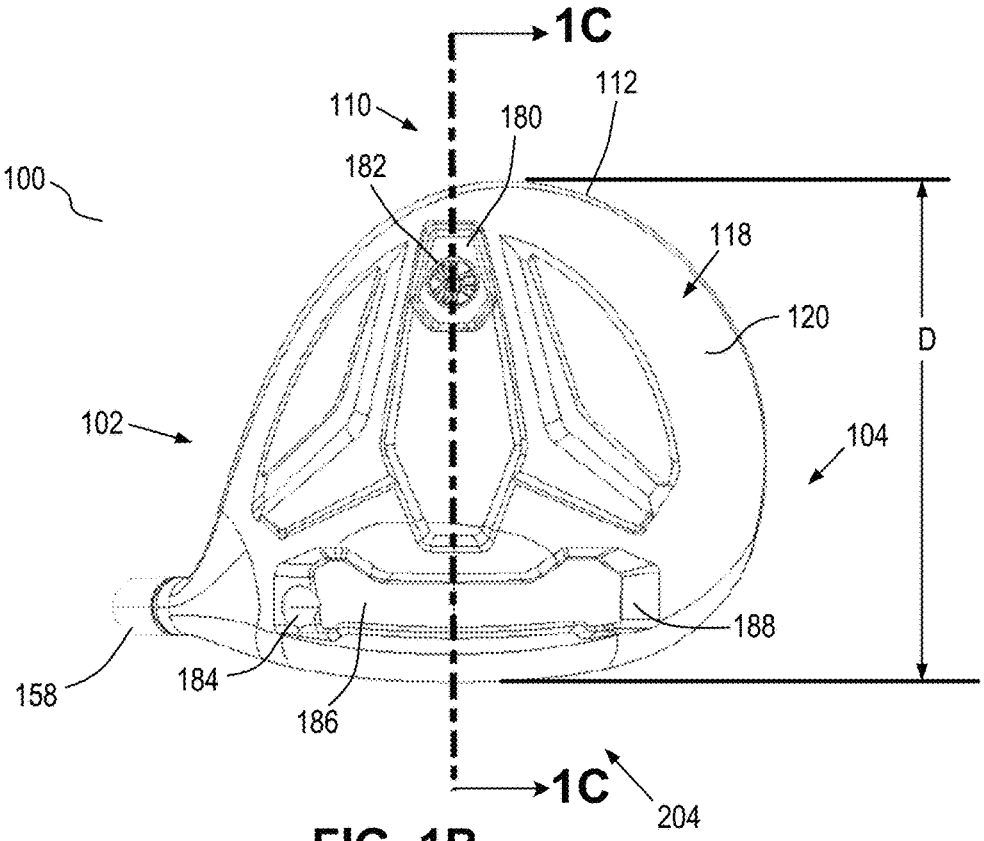
FIG. 1B is a bottom side view of a golf club head according to some embodiments.

FIG. 1B illustrates a bottom side view of golf club head 100 showing bottom side 118 and an edge 112 between top side 114 and bottom side 118. In some embodiments, golf club head 100 may be provided with a weight port 180 and an adjustable weight 182 located in weight port 180. In some embodiments, weight port 180 and adjustable weight 182 may be the same as or similar to the ports and weights described in U.S. Pat. No. 7,407,447 patented on Aug. 5, 2008, herein incorporated by reference in its entirety by reference thereto.

In some embodiments, golf club head 100 may include a recessed channel portion 186 having a channel sidewall 188 in a front portion of bottom side 118 of golf club head 100 proximate to club face 108. Within channel portion 186, a fastener opening 184 may be provided to allow the insertion of a mechanical fastener 163, such as a screw, for engaging with hosel insert 158 for attaching a shaft (e.g., club shaft 1104) to golf club head 100 and/or to allow for an adjustable loft, lie, and/or face angle. In some embodiments, hosel insert 158 may be configured to allow for the adjustment of at least one of a loft, lie, or face angle described in U.S. Pat. No. 8,303,431, patented on Nov. 6, 2012, herein incorporated by reference in its entirety by reference thereto.

Figure 1C:
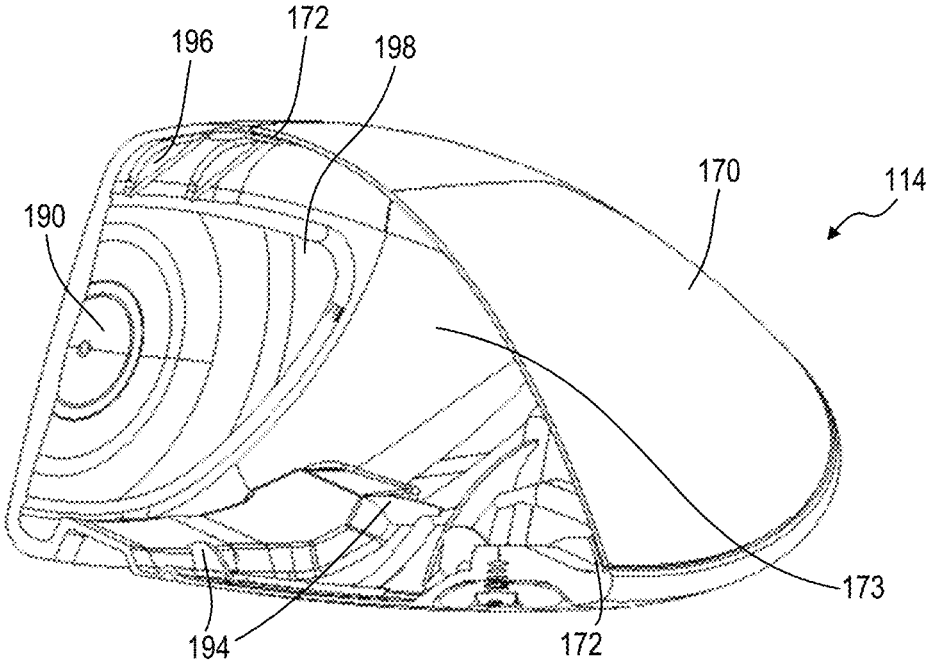
FIG. 1C is a cross-sectional view of a golf club head according to some embodiments taken along the section line 1C-1C in FIG. 1B.

FIG. 1C illustrates a cross-sectional view taken along lines 1C-1C in FIG. 1B. In some embodiments, a machined face insert 190 may be welded to a front opening 198 on golf club head 100. Face insert 190 may have a variable face thickness having an inverted recess in the center portion of the back surface of the face insert 190. In some embodiments, a crown insert 170 may define all or a portion of top surface 116 of top side 114 of golf club head 100. Crown insert 170 may be bonded to top side 114 of golf club head 100. In some embodiments, crown insert 170 may rest on a crown ledge 172. In some embodiments, crown insert 170 may be bonded to crown ledge 172. In some embodiments, crown insert 170 may comprise a composite material. In some embodiments, the composite material of crown insert 172 may be a composite lay-up including a plurality plies or layers.

In some embodiments, crown ledge 172 may have a length in range between 1-7 mm, 1-5 mm, or 1-3 mm. In some embodiments, crown ledge 172 may continuously extend around a circumference of an opening 173 formed on top side 114 of golf club head 100. In some embodiments, crown ledge 172 may extend around a portion of a circumference of an opening 173 formed on top side 114 of golf club head 100. In some embodiments, crown ledge 172 may include a plurality of discontinuous segments extending around all or a portion of opening 173 formed on top side 114 of golf club head 100. Crown insert 170 and crown ledge 172 may be considered to be the same element to crown insert 442 and crown ledge 450 discussed herein.

In some embodiments, a plurality of ribs 194 may be connected to an interior portion of channel portion 186 to improve the sound of golf club head 100 upon impact with a golf ball.

Figure 1D:
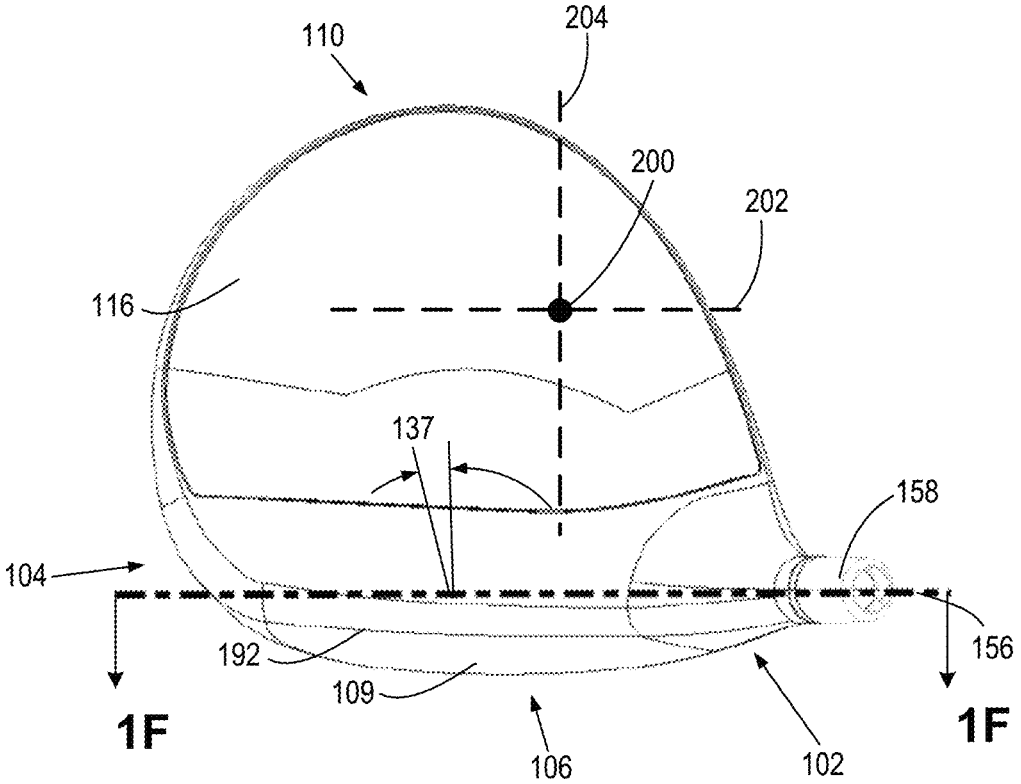
FIG. 1D is a top side view of a golf club head according to some embodiments.

FIG. 1D illustrates a top view of golf club head 100 in the address position. A hosel plane 156 is shown being perpendicular to ground plane 140 and containing hosel axis 154. In addition, a center face nominal face angle 137 is shown which may be adjusted by hosel insert 158. A positive normal face angle indicates golf club face 108 is pointed to the right of a center line target at a given measured point. A negative normal face angle indicates the golf club face 108 is pointed to the left of a centerline target at a given measured point. A topline 192 is also shown in FIG. 1D. Topline 192 is defined as the intersection of top surface 116 and club face 108 of golf club head 100. In some embodiments, the paint line of top surface 116 may stop at topline 192.

Figure 1E:
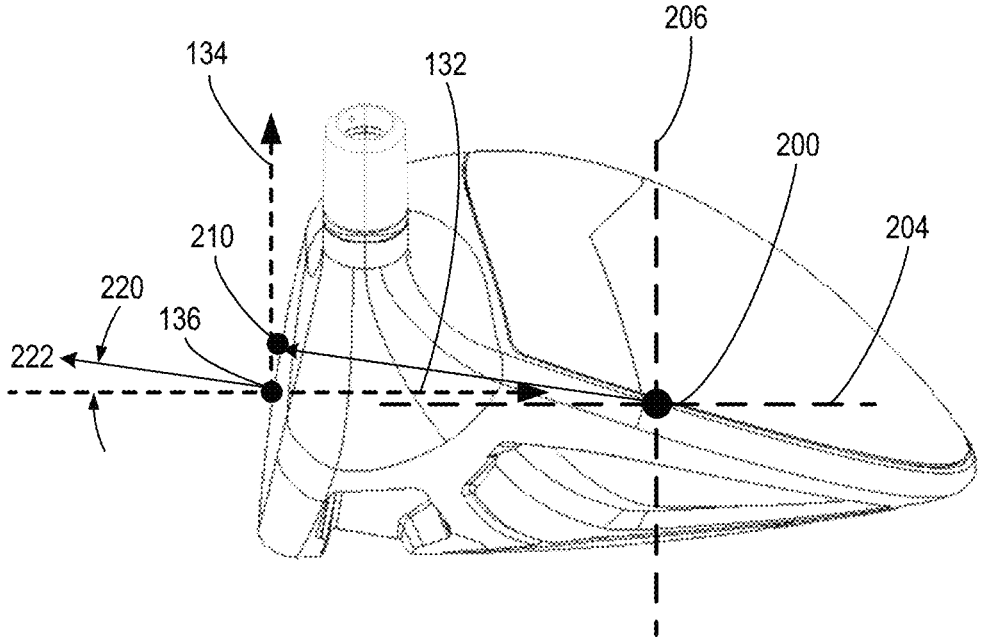
FIG. 1E is a heel side view of a golf club head according to some embodiments.

FIGS. 1D and 1E show golf club head's 100 moments of inertia may be defined about three axes extending through golf club head's 100 CG 200 including: a CG Z-axis 206 extending through CG 200 in a generally vertical direction relative to ground plane 140 when club head 100 is at address position, a CG X-axis 202 extending through CG 200 in a heel-to-toe direction generally parallel to striking face 109 and generally perpendicular to CG Z-axis 206, and a CG Y-axis 204 extending through CG 200 in a front-to-back direction and generally perpendicular to CG X-axis 202 and CG Z-axis 206. CG X-axis 202 and CG Y-axis 204 both extend in a generally horizontal direction relative to ground plane 140 when club head 100 is at the address position.

The moment of inertia about golf club head CG X-axis 202 is calculated by the following equation:

$$I_{CGx}=\int(y^2+z^2)dm \quad \text{(Equation 1)}$$

In equation 1 above, y is the distance from a golf club head CG xz-plane to an infinitesimal mass dm and z is the distance from a golf club head CG xy-plane to the infinitesimal mass dm. The golf club head CG xz-plane is a plane defined by CG X-axis 202 and CG Z-axis 206. The CG xy-plane is a plane defined by CG X-axis 202 and CG Y-axis 204.

Moreover, a moment of inertia about golf club head CG Z-axis 206 is calculated by the following equation:

$$I_{CGx}=\int(x^2+y^2)dm \quad \text{(Equation 2)}$$

In equation 2 above, x is the distance from a golf club head CG yz-plane to an infinitesimal mass dm and y is the distance from the golf club head CG xz-plane to the infinitesimal mass dm. The golf club head CG yz-plane is a plane defined by CG Y-axis 204 and CG Z-axis 206.

In certain implementations, golf club head 100 may have a moment of inertia about CG Z-axis 206 between about 450 kg·mm2 and about 650 kg·mm2, a moment of inertia about CG X-axis 202 between about 300 kg·mm2 and about 500 kg·mm2, and a moment of inertia about CG Y-axis 204 between about 300 kg·mm2 and about 500 kg·mm2.

FIG. 1E shows a heel side view of club head 100 and provides a side view of positive center face Y-axis 132 and how CG 200 is projected onto club face 108 at projected CG location 210 previously described. A nominal center face loft angle 220 is shown to be the angle created by a perpendicular center face vector 222 relative to a horizontal plane parallel to ground plane 140.

Figure 1F:
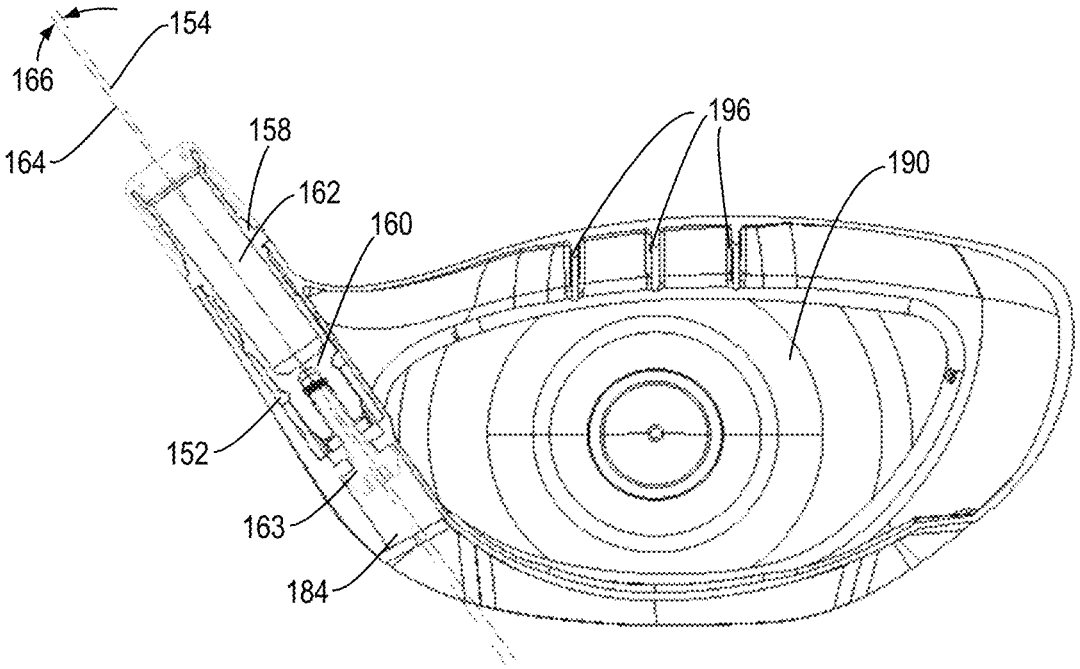
FIG. 1F is a cross-sectional view of a golf club head according to some embodiments taken along section line 1F-1F in FIG. 1D.

FIG. 1F illustrates a cross-sectional view taken along line 1F-1F shown in FIG. 1D. Mechanical fastener 163 is more easily seen being inserted into fastener opening 184 for threadably engaging with a sleeve 160. Sleeve 160 may include a sleeve bore 162 for allowing a golf club shaft (e.g., club shaft 1104) to be inserted for adhesive bonding with sleeve 160. In some embodiments, hosel 150 or a portion thereof (e.g., hosel insert 158) may be configured to receive sleeve 160. In some embodiments, a golf club head 100 may include a plurality of crown ribs 196 to strengthen the transition portion between club face 108 and top surface 116.

In some embodiments, golf club heads described herein may include one or more adjustable loft, lie, or face angle systems that are capable of adjusting the loft, lie, or face angle either in combination with one another or independently from one another. For example, a portion of hosel insert 158, sleeve bore 162, and a golf club shaft (e.g., club shaft 1104) collectively define a longitudinal axis 164 (see FIG. 1F) of an assembled golf club. In some embodiments, longitudinal axis 164 may be co-axial with sleeve bore 162. A portion of sleeve 160 is effective to support the shaft along the longitudinal axis 164 of the assembly, which is offset from hosel axis 154 of hosel tube bore 152 by an offset angle 166. Hosel axis 154 is co-axial with hosel tube bore 152. Hosel insert 158 can provide a single offset angle 166 that can be between 0 degrees and 4 degrees, in 0.25 degree increments. For example, offset angle 166 can be 1.0 degree, 1.25 degrees, 1.5 degrees, 1.75 degrees, 2.0 degrees, 2.25 degrees, 2.5 degrees, 2.75 degrees, or 3.0 degrees. The offset angle 166 of the embodiment shown in FIG. 1F is 1.5 degrees. In some embodiments, sleeve 160 may be capable of being positioned to adjust the loft, lie, or face angle of the golf club head 100.

Figure 2:
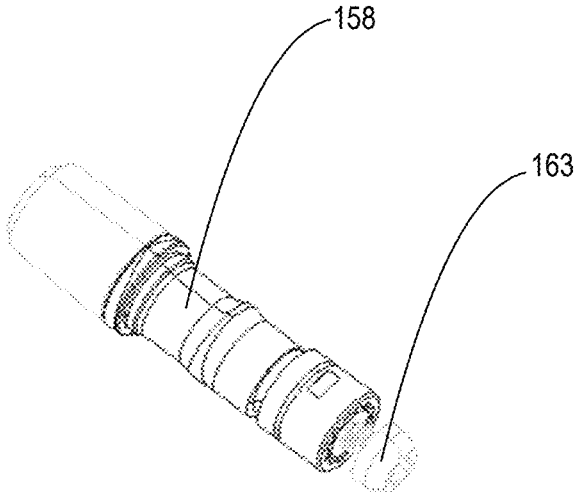
FIG. 2 is an isometric view of a hosel insert according to an embodiment.

FIG. 2 illustrates hosel insert 158 and mechanical fastener 163 removed from golf club head 100. In some embodiments, hosel insert 158 may be the same as or similar to the adjustable hosel insert described in U.S. Pat. No. 8,303,431, filed on Nov. 6, 2012, herein incorporated by reference in its entirety by reference thereto.

Figure 3A:
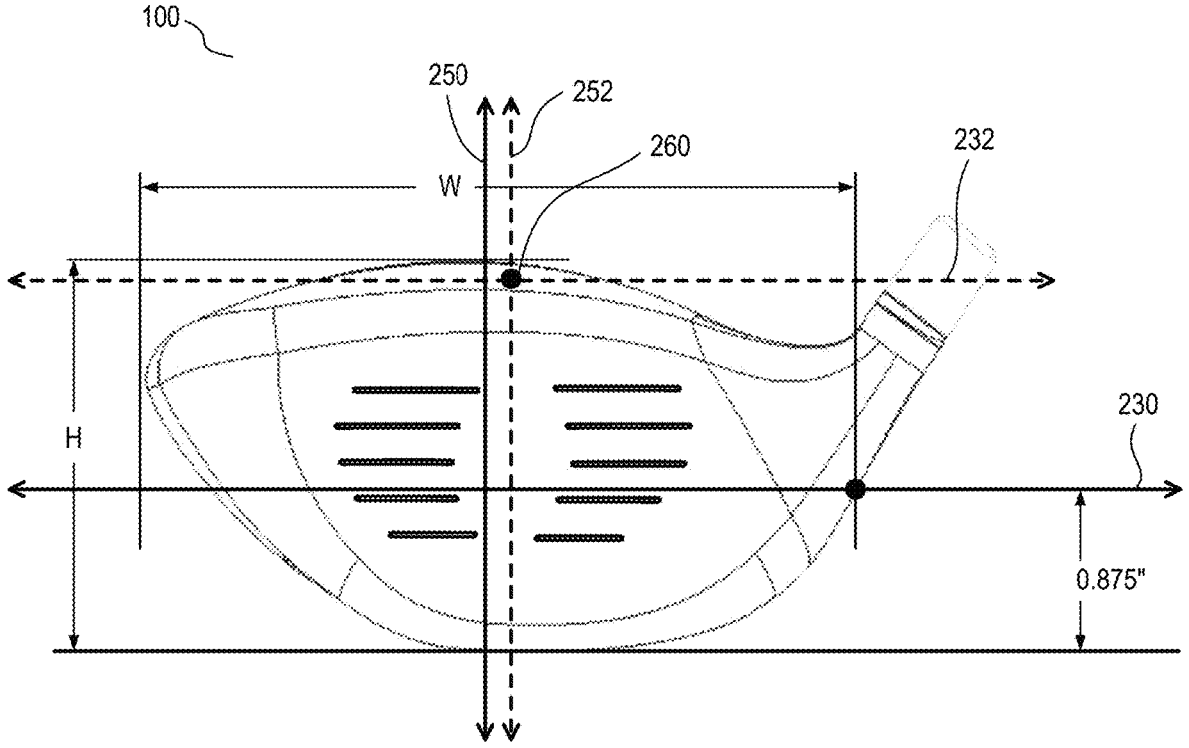
FIG. 3A is a front side view of a golf club head showing central measurement axes according to some embodiments.
Figure 3B:
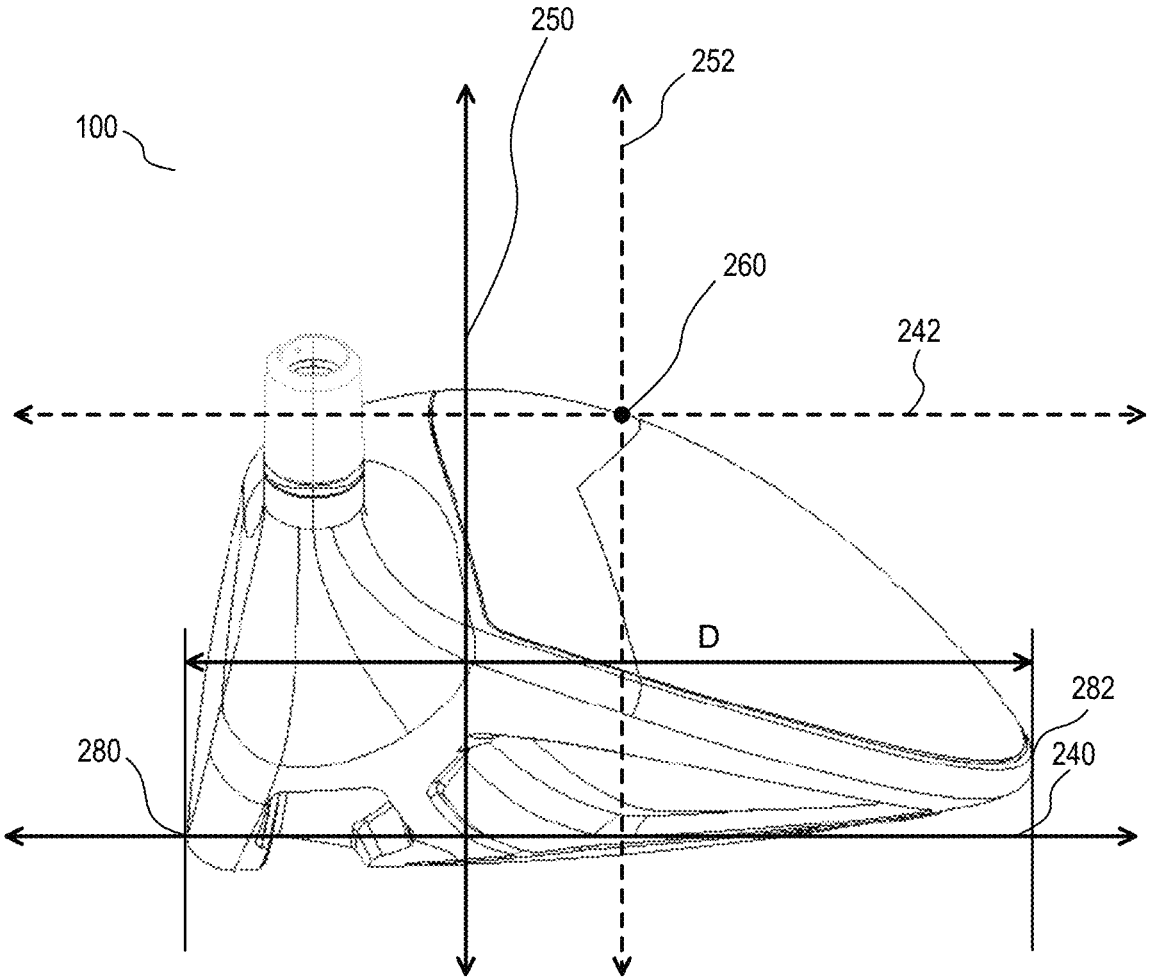
FIG. 3B is a heel side view of the golf club head in FIG. 3A.
Figure 3C:
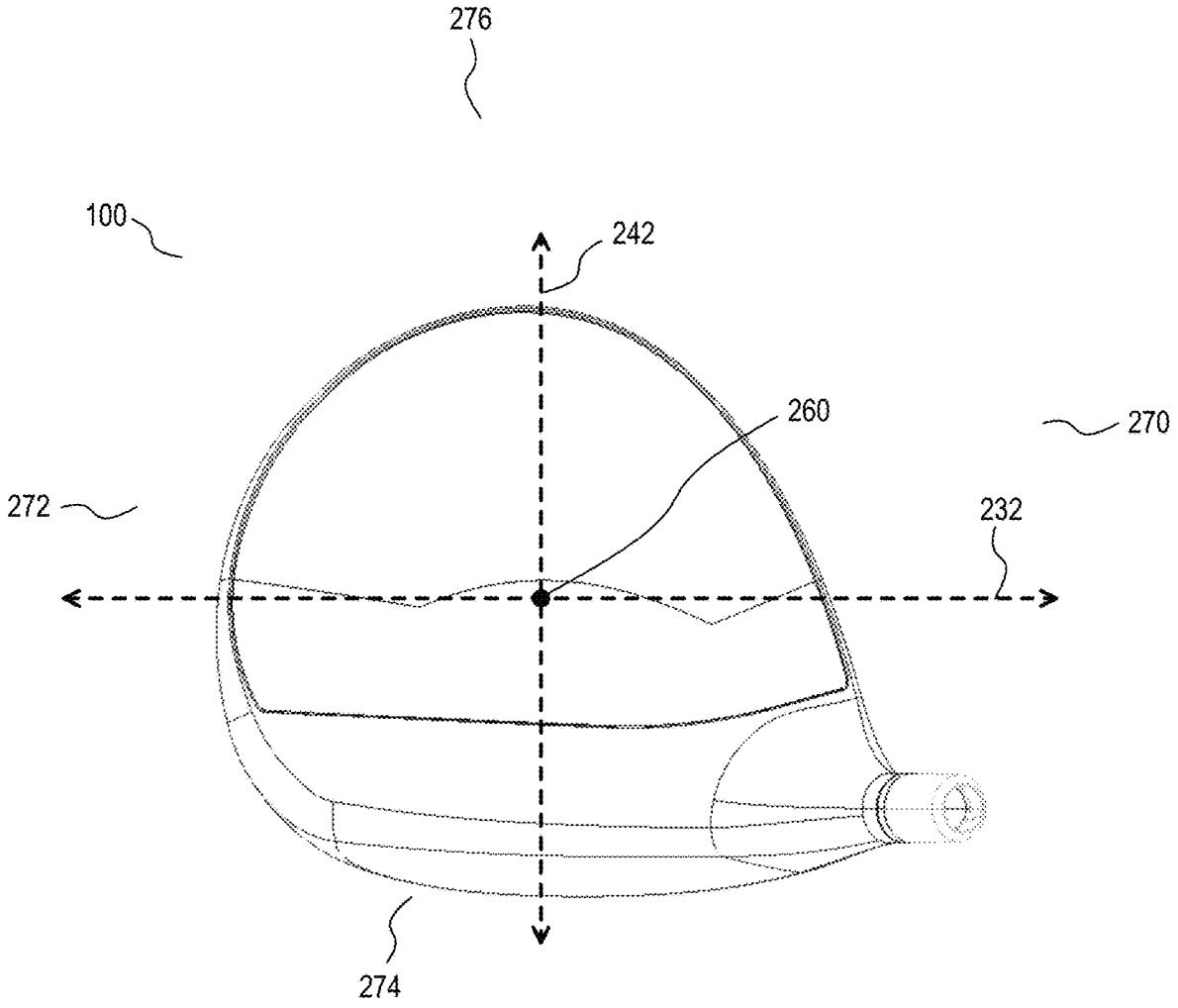
FIG. 3C is a top view of the golf club head in FIG. 3A.

FIGS. 3A-3C show X-axis 230, Y-axis 240, and Z-axis 250 relative to golf club head 100. As discussed above, axes 230, 240, and 250 are used to measure the width W, the depth D, and the height H of golf club head 100. FIGS. 3A-3C also show central X-, Y-, and Z-axes that define a central coordinate system for purposes of this application.

This central coordinate system may be used to determine one or more critical dimensions between a perimeter edge (or wall) of a crown insert and a bonding wall on a club head body. These critical dimensions are used to characterize the junction between a crown insert and a bonding wall. These critical dimensions are used to determine the separation between the crown insert and the bonding wall at a junction between the two.

Tailoring these critical dimensions to desired values may help inhibit the formation of stress concentration centers at a junction between a bonding wall and a crown insert. For example, tailoring a plurality of critical dimensions to be less than or equal to certain value may help inhibit the formation of stress concentrations. Further, tailoring a plurality of critical dimensions to have an average variation between points of less than or equal to a certain value may help inhibit the formation of stress concentrations.

Inhibiting the formation of stress concentration centers may in turn inhibit the formation of cracks in an adhesive bonding the crown insert to the bonding wall at the junction between the two. Cracks in the adhesive may result in structural and/or visual defects for a club head. Tailoring critical dimensions to be at or below a certain value and/or tailoring them to have an average variation between points at or below a certain value may eliminate cracking.

A central Z-axis 252 is defined as the axis extending in a vertical direction parallel to Z-axis 250 and through top side 114 of golf club head 100 at a midpoint of the width W dimension and a midpoint of the depth D dimension (hereinafter referred to as "midpoint 260"). The midpoint of the width W dimension is the total value of the width W dimension divided by two. The midpoint of the depth D dimension is the total value of the depth D dimension divided by two.

A central Y-axis 242 is defined as the axis intersecting central Z-axis 252 at top surface 116 of club head 100 and extending parallel to Y-axis 240. In other words, central Y-axis 242 is defined by the axis intersecting top surface 116 at midpoint 260 and extending parallel to Y-axis 240. A central X-axis 232 is defined as the axis intersecting central Z-axis 252 at top surface 116 of club head 100 and extending parallel to X-axis 230. In other words, central X-axis 232 is defined by the axis intersecting top surface 116 at midpoint 260 and extending parallel to X-axis 230.

Central X-, Y-, and Z-axes are used to define vertical planes at critical points for measuring critical dimensions between a crown insert of a golf club head and a bonding wall of the golf club head. Further, central X- and Y-axes may be used to define heel, toe, front, and rear portions of a golf club head for purposes of this application. FIG. 3C shows heel portion 270, toe portion 272, front portion 274, and rear portion 276 of club head 100. Heel portion 270 of club head 100 is defined by the portion of club head 100 on the heel side of central Y-axis 242. Toe portion 272 of club head 100 is defined by the portion of club head 100 on the toe side of central Y-axis 242. Front portion 274 of club head 100 is defined by the portion of club head 100 on the front side of central X-axis 232. Rear portion 276 of club head 100 is defined by the portion of club head 100 on the rear side of central X-axis 232.

While axes, measurements, portions, and geometrical locations (e.g., center of gravity) are shown relative to golf club head 100 in FIGS. 1A-1F and 3A-3C, these axes and measurements apply to any golf club head (e.g., golf club head 400 or golf club head 1000). The location of the axes and the measurements for W, D, and H may vary depending on the size and shape of a given golf club head.

FIG. 4A-4D show a golf club head 400 according to some embodiments. Similar to golf club head 100, golf club head 400 includes a heel side 402, a toe side 404, front side 406 having a club face 408 and a striking face 409, a rear side 410, a top side 414 (also called a crown) having top surface 416, a bottom side 418 (also called a sole or sole portion) having a bottom surface 420, a hosel (also called a hosel portion) 430, and a hosel insert 432. Hosel insert 432 may be the same as or similar to hosel insert 158. Golf club head 400 has a width dimension W, a height dimension H, and a depth dimension D that may be the same as or similar to the dimensions discussed above for golf club head 100 and may be measured in the same fashion as described above for golf club head 100.

In some embodiments, golf club head 400 may include one or more removable shaft mechanisms. In some embodiments, hosel insert 432 may include a removable shaft to allow for the adjustment of at least one of a loft, lie, or face angle of golf club head 400 in the same fashion as described for hosel insert 158. In some embodiments, golf club head 400 may include movable weight technology including one or more movable weights 434 configured to slide within recessed channel(s) 436 formed in golf club head 400. In some embodiments, recessed channels 436 may be formed in bottom side 418 of golf club head 400. In some embodiments, a recessed channel 436 proximate to club face 408 may include a fastener opening 437 to allow the insertion of a mechanical fastener, such as a screw, for engaging with hosel insert 432 for attaching a shaft (e.g., club shaft 1104) to golf club head 400 and/or to allow for an adjustable loft, lie, and/or face angle.

Movable weights 434 may include a fastener 438 for releasably securing movable weights 434 to club head 400. When a fastener 438 is loosened, a movable weight 434 may slide within a recessed channel 436. When a fastener 438 is tightened, a movable weight 434 may be fixed in a specific location within a recessed channel 436. In some embodiments, recessed channel(s) 436 and/or movable weight(s) 434 may be the same as or similar to the channels and weights described in U.S. application Ser. No. 14/789,838, filed on Jul. 1, 2015, herein incorporated by reference in its entirety by reference thereto.

In some embodiments, golf club head 400 may include one or more bottom surface panels/inserts 439 (also called sole panels/inserts). Bottom surface panels 439 may define a portion of bottom surface 420 of club head 400. In some embodiments, bottom surface panels 439 may be panels comprising a composite material. In some embodiments, the composite material of bottom surface panel(s) 439 may be a composite lay-up including a plurality plies or layers. In some embodiments, the bottom surface panels 439 are inserted into a recess located in the sole portion.

In certain embodiments, the carbon fiber sole panels 439 are two separate panels or one continuous panel of carbon fiber. Carbon fiber sole panels 439 may have the same level of dimensional accuracy as the crown carbon fiber panel (also called crown insert) described herein. In the event that the carbon fiber panel on the crown or the sole are not located at the midpoint of the club head, a secondary alternative midpoint can be found by measuring the maximum front-to-back dimension of a single composite panel along, or parallel to, the central Y-axis and a maximum heel-to-toe dimension of the single composite panel along, or parallel to, the central X-axis. The alternative secondary midpoint is defined as the intersection of a midpoint of the maximum front-to-back dimension of the composite panel (located on either crown or sole) and a midpoint of the maximum heel-to-toe dimension of the composite panel. Once the alternative secondary midpoint is established, the composite panel can be evaluated for consistency utilizing the same methods that are applied to a midpoint located in the central portion of the club head (e.g., midpoint 260).

Composite material bottom surface panels 439 may help minimize the weight of golf club head 400 without sacrificing mechanical properties due to the composite material's high strength-to-weight properties. Suitable composite materials for bottom surface panels 439 include, but are not limited to, carbon fiber composites and fiber glass composites. In some embodiments, bottom surface panels 439 may be the same as or similar to the panels described in U.S. application Ser. No. 15/233,805, filed on Aug. 10, 2016, herein incorporated by reference in its entirety by reference thereto.

The composite panels located in either the crown or the sole region may be made from a variety of composite and polymeric materials, and can be made from either a thermoplastic or thermoset material. In some embodiments, a thermoplastic composite laminate material or a thermoplastic carbon composite laminate material can be used. The composite material may be an injection moldable material, a thermo-formable material, a thermoset composite material, or other composite material suitable for golf club head applications.

One exemplary material is thermoplastic continuous carbon fiber composite laminate material having long aligned carbon fibers in a PPS (polyphenylene sulfide) matrix or base. One commercial example of this type of material, which is manufactured in sheet form, is TEPEX® DYNALITE 207 manufactured by Lanxess. The material may have a fiber volume from 42%-57% in some embodiments. In some embodiments, the material weighs 200 g/m$^2$ or less.

In some embodiments, the carbon fiber crown or sole insert material may be a unidirectional carbon fiber material or a chopped carbon fiber material. In a thermoset process, the sole or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder or compression mold and stacked/oriented with the carbon or other fibers oriented in different directions such as 0°, +45°, −45°, 90° or −90° relative to a front to back axis. In one embodiment, the prepreg sheets have a quasi-isotropic layup having an areal weight of about 70 g/m$^2$ or between 40 g/m$^2$ and 100 g/m$^2$. In one embodiment, the epoxy resin used to impregnate the prepreg sheets (such as Newport 301) has a resin content (R/C) of about 40% or between 20% and 80%.

The carbon fiber reinforcement material for the thermoset sole/crown insert may be a carbon fiber known as "34-700" fiber, available from Grafil, Inc., of Sacramento, Calif., which has a tensile modulus of 235 GPa (34 Msi) and tensile strength of 4500 MPa (650 Ksi). In some embodiments, the tensile modulus is between 100 GPa and 400 GPa and a tensile strength between 2000 MPa and 6000 MPa.

In some embodiments, the upper visible layer (e.g., upper layer 1210 shown in FIG. 12) of the composite layup may be a 3K weave or a braided weave and extends to the edge of the insert located at the front portion of the crown or sole insert. A benefit of producing a highly consistent first critical dimension across various critical points on the insert is that the edges of the upper layer (such as the weave) can be visibly located at the intersection of the composite insert and body without having leaving noticeable variations in the upper layer.

In some embodiments, bottom side 418 of club head 400 may include one or more ledges and bonding walls defining one or more recesses configured to receive at least a portion of bottom surface panel(s) 439. These ledges and bonding walls may have a similar construction as crown ledge 450 and bonding wall 454 described herein. Further, bottom surface panels 439 may be positioned in the recesses in the same fashion as discussed herein for crown insert 442. For example, measurement and tailoring of critical dimensions at the junction(s) between bottom surface panel(s) 439 and bottom side 418 of club head may be performed in a similar fashion as discussed herein for crown insert 442 and top side 414 of club head 400.

Top side 414 (i.e. crown) of club head 400 may be defined by a crown portion 440 and a crown insert 442. Crown portion 440 and crown insert 442 may be separately formed pieces attached by an adhesive such as a two part epoxy. In some embodiments, crown insert 442 may comprise a composite material. In some embodiments, the composite material of crown insert 442 may be a composite lay-up including a plurality plies or layers. Suitable composite materials for crown insert 442 include, but are not limited to, carbon fiber composites and fiber glass composites, as described above. In some embodiments, crown or sole insert may be composed of a metallic material, such as but not limited to, aluminum, titanium, tungsten, magnesium, or an alloy including one or more of these materials. In some embodiments, the crown or sole insert may be a lower density material than the remainder of the club head body, such as plastic or short fiber composites.

In some embodiments, crown portion 440 may include a crown recess region 458 (shaded gray in FIG. 4B for illustration purposes) defined by a crown ledge 450 and a bonding wall 454. When assembled with crown portion 440, crown insert 442 may be disposed at least partially within crown recess region 458. In some embodiments, crown recess region 458 may receive the entire crown insert 442. In some embodiments, crown recess region 458 may include an opening 490 formed in club head 400.

Bonding wall 454 and crown ledge 450 may define all or a portion of a perimeter of crown recess region 458. In some embodiments, bonding wall 454 and crown ledge 450 may define a crown recess region 458 having a perimeter shape that completely surrounds midpoint 260 (i.e., disposed radially about midpoint 260 in 360 degrees of rotation) (see e.g., perimeter shape of crown recess region 458 in FIG. 4B). In other words, bonding wall 454 and crown ledge 450 may continuously extend around a circumference of opening 490 formed on top side 414 of golf club head 400.

In some embodiments, bonding wall 454 and crown ledge 450 may define a crown recess region 458 having a perimeter shape that only partially surrounds midpoint 260. For example, crown recess region 458 may surround midpoint 260 in a front portion of club head 400 and all or a portion of the rear portion of club head 400 may be devoid of a crown recess region. In other words, bonding wall 454 and crown ledge 450 may extend around a portion of the circumference of opening 490. In such embodiments, a portion of crown insert 442 may be bonded directly to top surface 441 of crown portion 440 on a portion of club head 400 (e.g., the rear portion of club head 400). In certain embodiments, the bonding wall 454 extends around a portion of the circumference of opening 490 by less than 20%, less than 30%, less than 40%, less than 50%, less than 70%, less than 80%, or less than 90% of the entire perimeter of the crown recess region 458.

In some embodiments, bonding wall 454 may include a plurality of discrete bonding wall sections 455, which together define bonding wall 454. Similarly, in some embodiments, crown ledge 450 may include a plurality of discrete crown ledge sections 459, which together define crown ledge 450.

A crown ledge surface 452 of crown ledge 450 may support crown insert 442 within crown recess region 458. In some embodiments, crown ledge surface 452 may include one or more protrusions 453 for supporting a bottom surface 448 of crown insert 442 (see e.g., FIG. 5A). In some embodiments, protrusions 453 may be integrally formed with crown ledge surface 452. In some embodiments, protrusions 453 may be separate elements fixed to crown ledge surface 452 (e.g., via welding or an adhesive).

In some embodiments, protrusion(s) 453 may have a height or ledge gap (also known as bond-line thickness) 470 (see e.g., FIG. 5B) of no more than 0.5 mm. In some embodiments, height 470 may be no more than 0.3 mm. In some embodiments, height 470 may be no more than 0.2 mm. In some embodiments, height 470 may be no more than 0.1 mm. Protrusion(s) 453 may help position bottom surface 448 of crown insert 442 at a desired distance above crown ledge surface 452 to provide space for an adhesive bonding bottom surface 448 to crown ledge 450. In some embodiments, the protrusion(s) 453 may be absent but a ledge gap may be present. In some embodiments, crown ledge surface 452 may define a ledge gap between crown ledge surface 452 and crown insert 442. For example, crown ledge surface 452 may define a ledge gap of no more than 0.3 mm, or between 0.2 mm and 0.3 mm.

In some embodiments, protrusion(s) 453 may help level crown insert 442 within crown recess region 458 (i.e., help ensure a perimeter wall 444 and a top surface 443 of crown insert 442 are properly aligned with bonding wall 454 and a top surface 441 of crown portion 440). In some embodiments, different protrusions 453 on crown ledge surface 452 may have different heights 470. In some embodiments, crown ledge surface 452 may include a single protrusion 453 extending along crown ledge surface 452. In some embodiments, the single crown ledge protrusion 453 may have a height 470 that varies along crown ledge surface 452.

In some embodiments, crown ledge 450 may include one or more regions of increased length 451. A region of increased length 451 may be located in toe portion, heel portion, front portion, or rear portion of club head 400. As a non-limiting example, crown ledge 450 may include a front portion 472 including a region of increased length 451. Regions of increased length 451 may facilitate bonding of crown insert 442 to crown ledge 450 by providing a larger surface area for bonding. In some embodiments, regions of increased length 451 may be located in the region(s) on crown 414 that experience the highest stress when club head 400 strikes a golf ball.

Figure 5A:
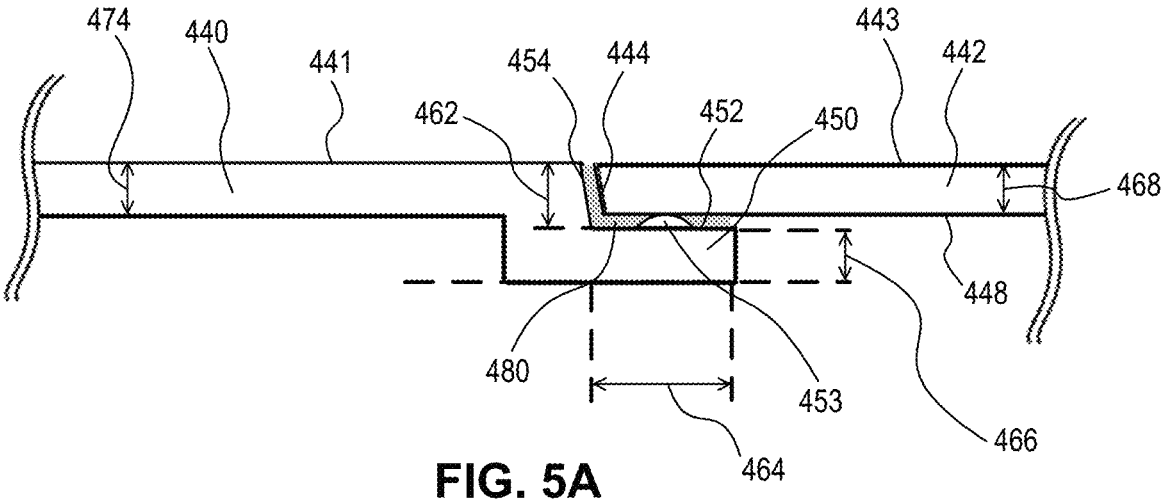
FIG. 5A is a cross-sectional view of a golf club head taken perpendicular to a bonding wall at a critical point according to some embodiments.

In some embodiments, an adhesive 480 may be used to bond crown insert 442 to bonding wall 454 and/or crown ledge 450 (see e.g., FIG. 5A). Suitable adhesives include, but are not limited to, epoxy resins, or two part epoxies such as DP460 manufactured by 3M®.

In some embodiments, at least a portion of top surface 443 of crown insert 442 at top perimeter edge 445 of crown insert 442 may be disposed below top surface 441 of crown portion 440 at bonding wall 454 by a vertical distance 460. Locating top surface 443 a vertical distance 460 below top surface 441 may facilitate the formation of a flush surface at the interface between crown insert 442 and crown portion 440 after top surface 443 is coated with a paint layer. As used herein, the term "flush" refers to a top surface 443 of crown insert 442 and a top surface 441 of crown portion 440 sharing the same geometric plane, at least at their edges. In some embodiments, flush surfaces may be flush within a deviation of +/−0.02 mm. A flush surface at the interface between crown insert 442 and crown portion 440 may help conceal the location of adhesive 480, which may not be as aesthetically appealing as the material and/or paint layers of crown portion 440 and crown insert 442.

In some embodiments, the crown or sole insert is a different paint or color from the golf club head body. Therefore, the bond gap (measured by a critical dimension, such as the first critical dimension) between the crown or sole insert is visible to the user. In such instances, the crown or sole insert is not necessarily flush (having a deviation of greater than +/−0.02) and can expedite ease of assembly by allowing for non-flush surfaces between the crown or sole insert and the club head body.

In some embodiments, the color contrast between the crown/sole insert relative to a directly adjacent body portion on the sole or crown is high. A transition from a dark color to a light color can be defined as "high contrast" if a L* value between insert and body portion has a difference of more than 50. In some embodiments, a contrast is defined as a L* value difference of more than 10, more than 20, more than 30, or more than 40. In some embodiments, the L* values between the insert and adjacent body color are greater than 60 or greater than 65.

Examples are also described, for convenience, with respect to CIELab color spaced using L*a*b* color values or L*C*h color values, but other color descriptions can be used. As used herein, L* is referred to as lightness, a* and b* are referred to as chromaticity coordinates, C* is referred to as chroma, and h is referred to as hue. In the CIELab color space, +a* is a red direction, −a* is a green direction, +b* is a yellow direction, and −b* is the blue direction. L* has a value of 100 for a perfect white diffuser. Chroma and hue are polar coordinates associated with a* and b*, wherein chroma (C*) is a distance from the axis along which a*=b*=0 and hue is an angle measured counterclockwise from the +a* axis. The following description is generally based on values associated with standard illuminant D65 at 10 degrees. This illuminant is similar to outside daylight lighting, but other illuminants can be used as well, if desired, and tabulated data provided herein generally includes values for illuminant A at 10 degrees and illuminant F2 at 10 degree. These illuminants are noted in tabulated data simply as D, A, and F for convenience. The terms brightness and intensity are used in the following description to refer to CIELab coordinate L*.

The thickness of the paint coating on either the insert or body can vary based on the type of material being painted. For example, in one embodiment, a metal body is painted with a primer layer and paint layer having a combined thickness of about 45-60 microns and a clear coat layer of about 50-60 microns. In another embodiment, a composite body is painted with a primer layer and a paint layer having a combined thickness of about 25-40 microns and a clear coat layer of about 30-40 microns.

In some embodiments, vertical distance 460 may be in the range of 0.1 mm and 0.3 mm. In some embodiments, vertical distance 460 may be less than or equal to 0.3 mm. In some embodiments vertical distance 460 may be less than or equal to 0.2 mm. In some embodiments, vertical distance 460 may be less than or equal to 0.1 mm. In some embodiments, vertical distance 460 may be equal to the thickness of a paint layer to be painted on top surface 443 of crown insert 442. In some embodiments, the paint layer of crown insert 442 may have a different color and/or surface texture than the material or paint layer of crown portion 440.

In some embodiments, vertical distance 460 may be created by a bonding wall 454 having a maximum height 462 that is greater than the thickness 468 of crown insert 442. In some embodiments, maximum height 462 may be in the range of 1.0 mm to 0.9 mm. In some embodiments, thickness 468 of crown insert 442 may be no greater than 0.75 mm. In some embodiments, thickness 468 may be no greater than 0.65 mm or 1 mm. In some embodiments, crown insert 442 may be composed of a composite material with six plies defining thickness 468 of crown insert.

In some embodiments, crown portion 440 may have a thickness 474 in the range of 0.2 to 1.5 mm. In some embodiments, crown ledge 450 may have a thickness 466 in the range of 0.5 mm to 0.7 mm. In some embodiments, crown ledge 450 may have a length 464 in the range of 1 mm to 7.5 mm, 2 mm to 6 mm, or 3 mm to 5 mm. In some embodiments, regions of increased length 451 of crown ledge 450 may have a length 464 in the range of 5.0 mm to 10.0 mm. A significant advantage of having a very short and consistent bond gap or first critical dimension is that the ledge length 464 can be as short as possible and therefore save weight that can be relocated to a lower portion of the club head for lowering the CG location of the club head.

Figure 4A:
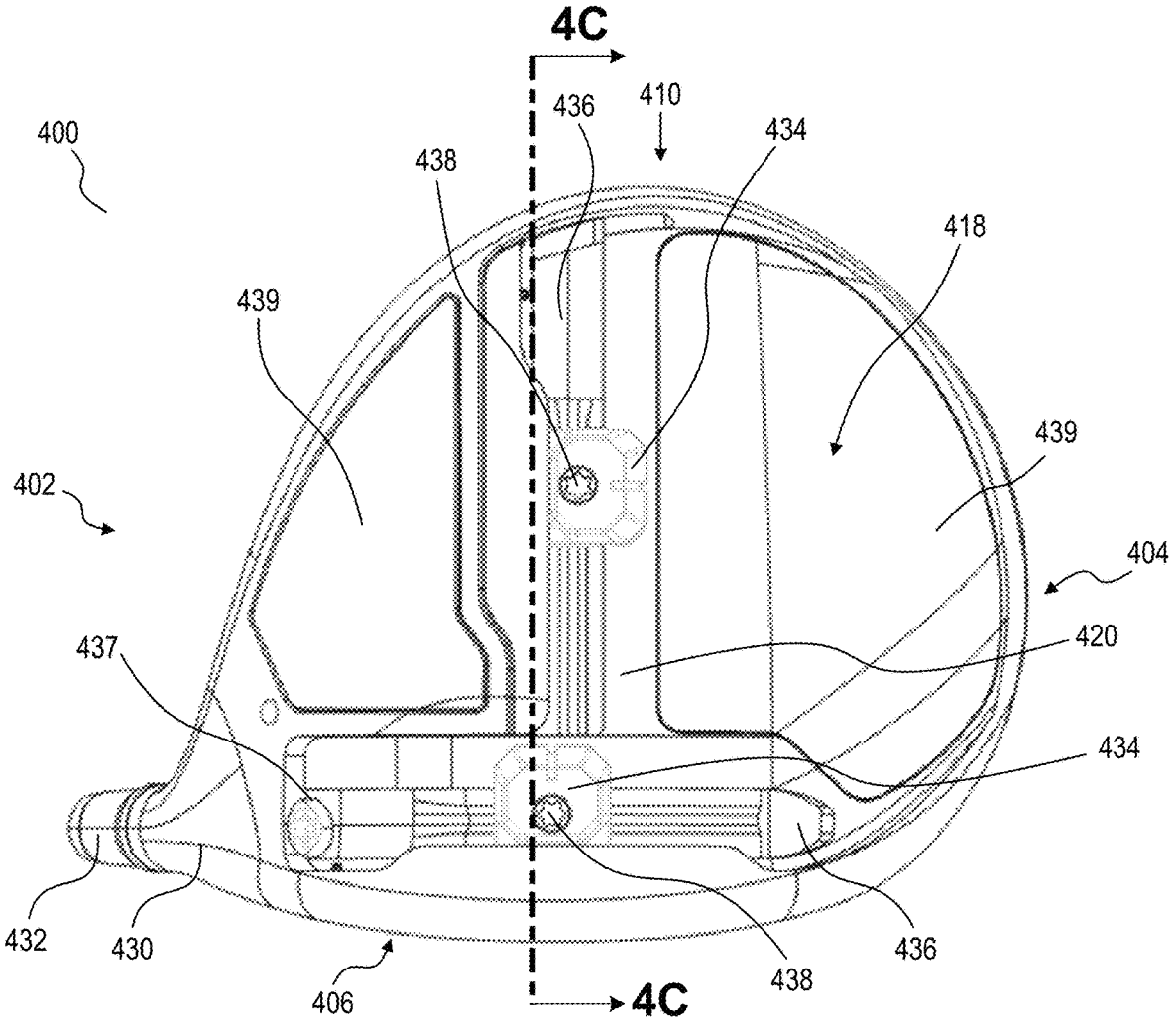
FIG. 4A is a bottom side view of a golf club head according to some embodiments.
Figure 4B:
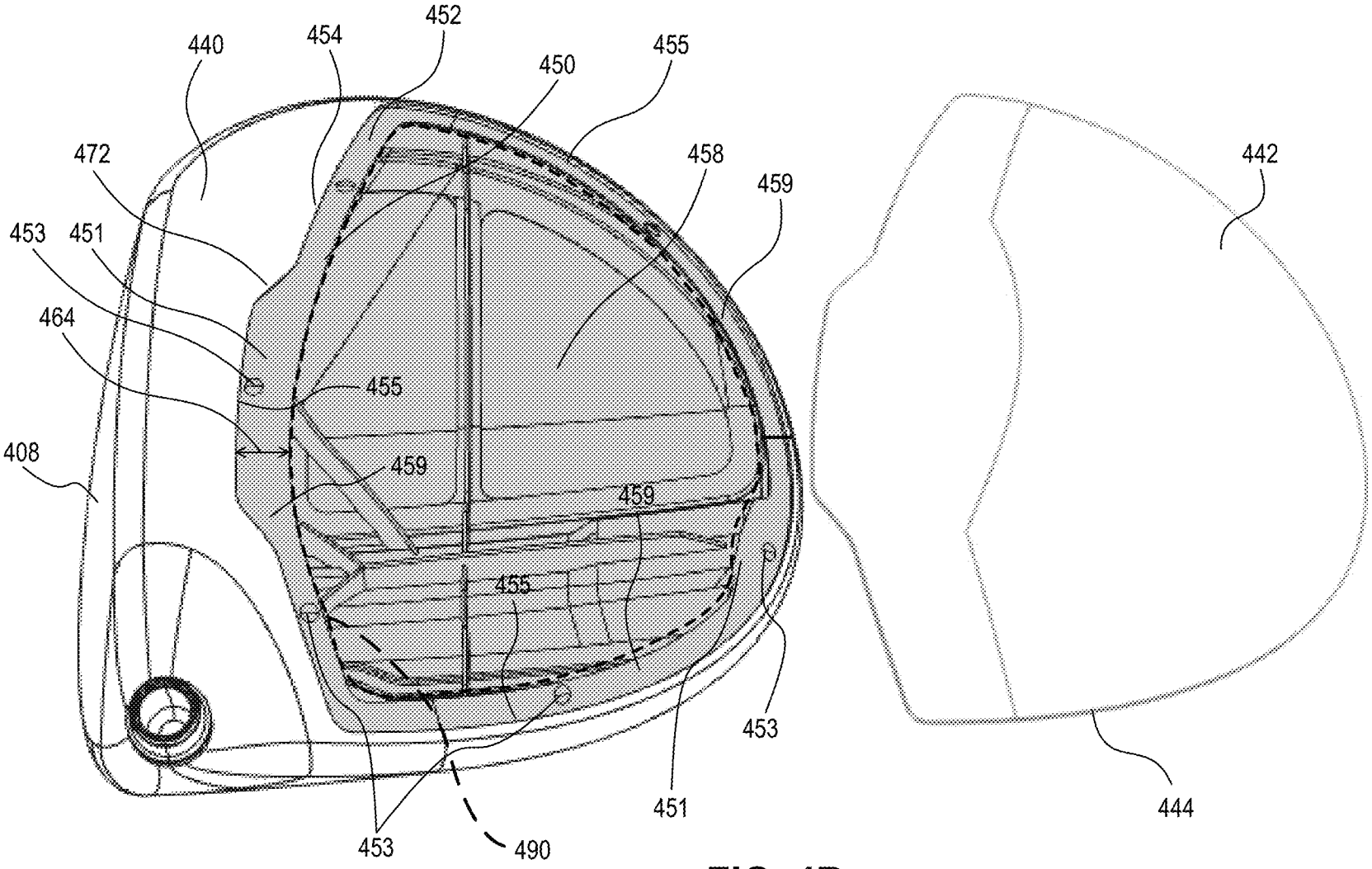
FIG. 4B is top view of a golf club head and a crown insert according to some embodiments.
Figure 4C:
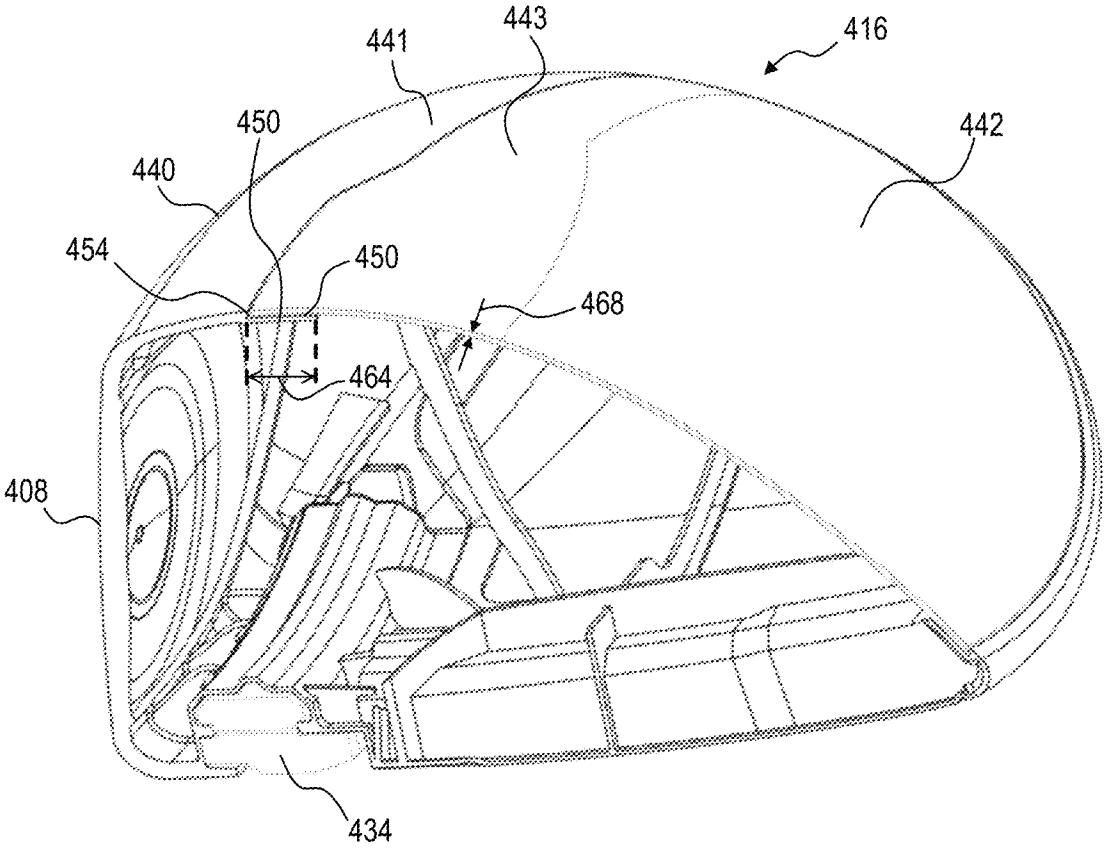
FIG. 4C is a cross-sectional view of a golf club head according to some embodiments taken along section line 4C-4C in FIG. 4A.
Figure 4D:
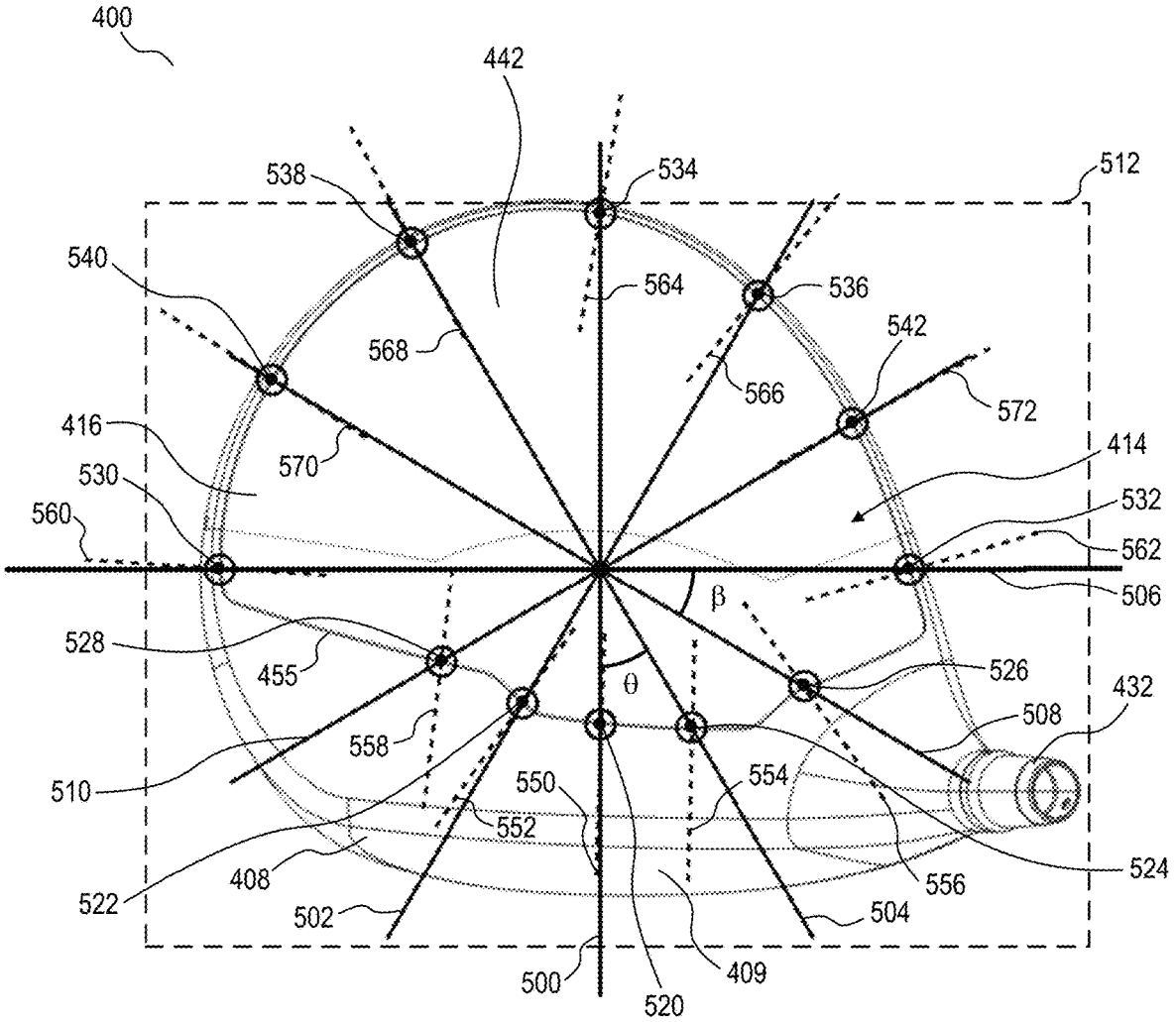
FIG. 4D is a top side view of a golf club head according to some embodiments.

FIG. 4D shows the following geometrical planes for golf club head 400. A first vertical plane 500 defined by the central Z-axis of golf club head 400 and the central Y-axis of golf club head 400.

A second vertical plane 502 defined by rotating first vertical plane 500 θ degrees clockwise about the central Z-axis of golf club head 400. For purposes of this application, clockwise is defined by the clockwise direction relative to top side 414 of golf club head (i.e., the view shown in FIG. 4D). In some embodiments, θ may be in the range of 1 degree to 45 degrees. In some embodiments, θ may be 2 degrees, 3 degrees, 4 degrees, 5 degrees, 10 degrees, 20 degrees, or 30 degrees.

A third vertical plane 504 defined by rotating first vertical plane 500 θ degrees counter-clockwise about the central Z-axis of golf club head 400.

A fourth vertical plane 506 defined by the central Z-axis of golf club head 400 and the central X-axis of golf club head 400.

A fifth vertical plane 508 defined by rotating fourth vertical plane 506 β degrees clockwise about the central Z-axis of golf club head 400. In some embodiments, β may be in the range of 1 degree to 44 degrees. In some embodiments, β may be 2 degrees, 3 degrees, 4 degrees, 5 degrees, 10 degrees, 20 degrees, or 30 degrees.

A sixth vertical plane 510 defined by rotating fourth vertical plane 506 β degrees counter-clockwise about the central Z-axis of golf club head 400.

An X-Y plane 512 defined by the central Y-axis of golf club head 400 and the central X-axis of golf club head.

FIG. 4D also shows the following critical points and cross-sections for golf club head 400. Critical points and cross-sections are used to measure critical dimensions for the purposes of this application.

A first critical point 520 located on a front portion of club head 400 at the intersection between first vertical plane 500 and a top edge 456 of bonding wall 454, and a first cross-section 550 taken on a vertical plane perpendicular to bonding wall 454 at first critical point 520.

A second critical point 522 located on the front portion of club head 400 at the intersection between second vertical plane 502 and top edge 456 of bonding wall 454, and a second cross-section 552 taken on a vertical plane perpendicular to bonding wall 454 at second critical point 522.

A third critical point 524 located on the front portion of club head 400 at the intersection between third vertical plane 504 and top edge 456 of bonding wall 454, and a third cross-section 554 taken on a vertical plane perpendicular to bonding wall 454 at third critical point 524.

A fourth critical point 526 located on the front portion of club head 400 at the intersection between fifth vertical plane 508 and top edge 456 of bonding wall 454, and a fourth cross-section 556 taken on a vertical plane perpendicular to bonding wall 454 at fourth critical point 526.

A fifth critical point 528 located on the front portion of club head 400 at the intersection between sixth vertical plane 510 and top edge 456 of bonding wall 454, and a fifth cross-section 558 taken on a vertical plane perpendicular to bonding wall 454 at fifth critical point 528.

A sixth critical point 530 located on a toe portion of club head 400 at the intersection between fourth vertical plane 506 and top edge 456 of bonding wall 454, and a sixth cross-section 560 taken on a vertical plane perpendicular to bonding wall 454 at sixth critical point 530.

A seventh critical point 532 located on a heel portion of club head 400 at the intersection between fourth vertical plane 506 and top edge 456 of bonding wall 454, and a seventh cross-section 562 take on a vertical plane perpendicular to bonding wall 454 at seventh critical point 532.

An eighth critical point 534 located on a rear portion of club head 400 at the intersection between first vertical plane 500 and top edge 456 of bonding wall 454, and an eighth cross-section 564 taken on a vertical plane perpendicular to bonding wall 454 at eighth critical point 534.

A ninth critical point 536 located on the rear portion of club head 400 at the intersection between second vertical plane 502 and top edge 456 of bonding wall 454, and a ninth cross-section 566 taken on a vertical plane perpendicular to bonding wall 454 at ninth critical point 536.

A tenth critical point 538 located on the rear portion of club head 400 at the intersection between third vertical plane 504 and top edge 456 of bonding wall 454, and a tenth cross-section 568 taken on a vertical plane perpendicular to bonding wall 454 at tenth critical point 538.

An eleventh critical point 540 located on the rear portion of club head 400 at the intersection between fifth vertical plane 508 and top edge 456 of bonding wall 454, and an eleventh cross-section 570 taken on a vertical plane perpendicular to bonding wall 454 at eleventh critical point 540.

A twelfth critical point 542 located on the rear portion of club head 400 at the intersection between sixth vertical plane 510 and top edge 456 of bonding wall 454, and a twelfth cross-section 572 taken on a vertical plane perpendicular to bonding wall 454 at twelfth critical point 542.

Figure 5B:
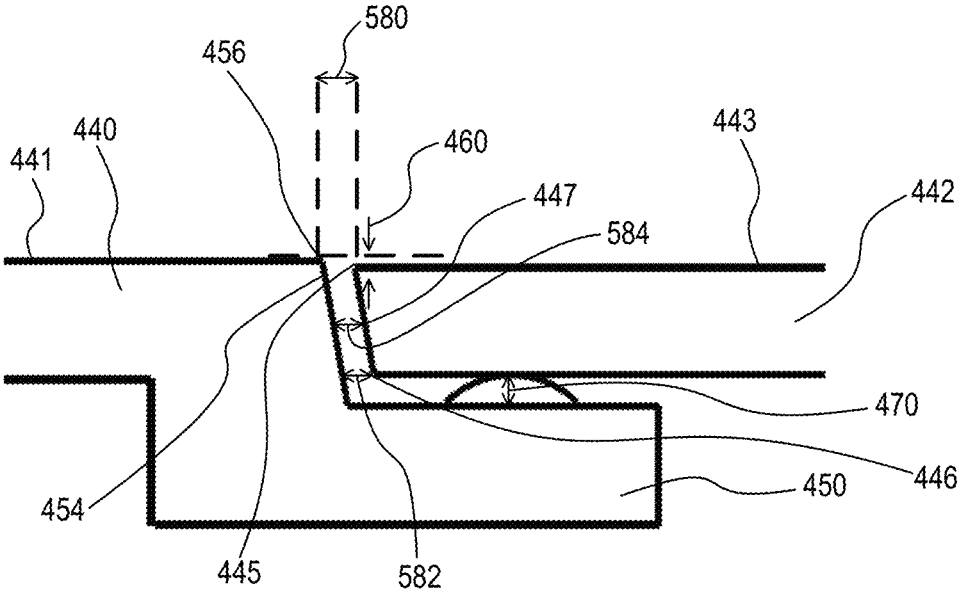
FIG. 5B is an enlarged view of a portion of FIG. 5A.

FIGS. 5A and 5B show a cross-sectional view of golf club head 400 according to some embodiments corresponding to any of cross-sections 550, 552, 554, 556, 558, 560, 562, 564, 566, 568, 570, and 572. As shown for example in FIG. 5B, each cross-section has a first critical dimension 580 measured parallel to X-Y plane 512 between top edge 456 of bonding wall 454 and a top perimeter edge 445 of crown insert 442. In other words, first critical dimension 580 measures the bond gap between bonding wall 454 and top perimeter edge 445 of crown insert 442. A small variation in the bond gap allows for a visible bond gap to be shown to the golfer and thereby minimizes the need for a paint layer to mask or cover the bond gap thereby hiding the imperfections of the bond gap. In one embodiment, the bond gap is visible to the user and does not have a paint layer or masking layer covering the bond gap area. In another embodiment, FIGS. 5A and 5B show a cross-sectional view of a golf club head having a sole insert located in a sole recess.

In some embodiments, first critical dimension 580 may be greater than 0 mm (e.g., due to the presence of adhesive 480 between crown insert 442 and bonding wall 454), but first critical dimension 580 may be no more than a certain value. In some embodiments, first critical dimension 580 of each cross-section is no more than A mm. In some embodiments, A may be equal to 4.0 mm. In some embodiments, A may be equal to 3.0 mm. In some embodiments, A may be equal to 2.0 mm. In some embodiments, A may be equal to 1.0 mm. In some embodiments, A may be less than 1.0 mm. For example, A may be equal to 0.9 mm, 0.8 mm, 0.7 mm, 0.6 mm, 0.5 mm, 0.4 mm, 0.3 mm, 0.2 mm, or 0.1 mm. In some embodiments, A may be between 0.6 mm and 0.1 mm.

In some embodiments, the average variation of the first critical dimensions 580 between a plurality of cross-sections 550, 552, 554, 556, 558, 560, 562, 564, 566, 568, 570, and 572 (e.g., two or more cross-sections, or three or more cross-sections) is no more than 0.2 mm, 0.15 mm, or 0.1 mm. In some embodiments, the average variation of the first critical dimensions 580 between all the cross-sections is no more than 0.15 mm, or 0.1 mm. In some embodiments, the average variation of the first critical dimensions 580 between a plurality of or all the cross-sections located on a front portion of club head 400 is no more than 0.2 mm, 0.15 mm, or 0.1 mm. For example, in some embodiments, the average variation of the first critical dimensions 580 between a plurality of or all cross-sections 550, 552, 554, 556, and 558 (i.e., first cross-section 550 through fifth cross-section 558) is no more than 0.2 mm, 0.15 mm, or 0.1 mm. In some embodiments, the average variation of the first critical dimensions 580 between a plurality of or all cross-sections 550, 552, 554, 556, 558, 560, and 562 (i.e., first cross-section 550 through seventh cross-section 562) is no more than 0.2 mm, 0.15 mm, or 0.1 mm.

In some embodiments, the average variation of the first critical dimensions 580 between a plurality of cross-sections 550, 552, 554, 556, 558, 560, 562, 564, 566, 568, 570, and 572 (e.g., two or more cross-sections, or three or more cross-sections) is no more than 0.05 mm. In some embodiments, the average variation of the first critical dimensions 580 between a plurality of cross-sections 550, 552, 554, 556, 558, 560, 562, 564, 566, 568, 570, and 572 (e.g., two or more cross-sections, or three or more cross-sections) is between 0.2 mm and 0.01 mm including subranges. In other words, the average variation of the first critical dimensions 580 between a plurality of cross-sections may be 0.2 mm, 0.19 mm, 0.18 mm, 0.17 mm, 0.16 mm, 0.15 mm, 0.14 mm, 0.13 mm, 0.12 mm, 0.11 mm, 0.1 mm, 0.09 mm, 0.08 mm, 0.07 mm, 0.06 mm, 0.05 mm, 0.04 mm, 0.03 mm, 0.02 mm, or 0.01 mm or within any range having any two of these values as endpoints.

In some embodiments, the average variation of the first critical dimensions 580 between a plurality of cross-sections may be less than 0.2 mm, less than 0.15 mm, less than 0.1 mm, less than 0.09 mm, less than 0.08 mm, less than 0.07 mm, less than 0.06 mm, less than 0.05 mm, less than 0.04 mm, less than 0.03 mm, less than 0.02 mm, or less than 0.01 mm. In some embodiments, the average variation of the first critical dimensions 580 between a plurality of cross-sections may be in the range between 0.5 mm and 0 mm, between 0.15 mm and 0 mm, between 0.2 mm and 0 mm, between 0.01 mm and 0.09 mm, between 0.02 mm and 0.08 mm, between 0.03 mm and 0.07 mm, or between 0.04 mm and 0.06 mm.

It is understood that although the phrase "two or more cross sections" is described for specific critical dimension ranges, it is contemplated that all the dimensional ranges described herein can be applied to three or more cross-sections, four or more cross-sections, five or more cross-sections, six or more cross-sections, seven or more cross-sections, eight or more cross-sections, nine or more cross-sections, ten or more cross-sections, eleven or more cross-sections, twelve or more cross-sections, twenty or more cross-sections, forty or more cross-sections, fifty or more cross-sections, one hundred or more cross-sections, two hundred or more cross-sections, and up to three hundred and sixty cross-sections. The number of cross-sections analyzed may depend on the values of $\beta$ and $\theta$ selected.

Table 1 below shows the average variation of the first critical dimensions 580 for the first cross-section 550 through the fifth cross-section 558 of a golf club head according to an embodiment. A is equal to 1.0 mm for the golf club head represented in Table 1.

TABLE 1

Average variation of the critical dimensions (measured in mm) for a first cross-sections through a fifth cross-section for a golf club according to an embodiment

| | Critical dimension (CD, mm) | Variation (V, mm) |
|---|---|---|
| First cross-section | 0.9 | 0.052 |
| Second cross-section | 0.85 | 0.002 |
| Third cross-section | 0.79 | 0.058 |
| Fourth cross-section | 0.95 | 0.102 |
| Fifth cross-section | 0.75 | 0.098 |
| Average | 0.848 | 0.0624 |

In Table 1, the variation (V) for each cross-section is equal to the absolute value of the difference between the critical dimension (CD) for a particular cross-section and the average of the plurality of critical dimensions. And the average variation is equal to the average of the variations for the plurality cross-sections.

In Table 1, the CD for each cross-section is averaged to result in an average CD across a plurality of points of 0.848 mm. Therefore, each CD is subtracted from the 0.848 mm average value and the absolute value is taken to result in a respective variation, V. Each individual variation, V, may also be averaged into an "average variation" variable. Table 1 shows an average variation value of 0.0624 mm.

As shown for example in FIG. 5B, each cross-section may also have a second critical dimension 582 measured parallel to X-Y plane 512 between bonding wall 454 and a bottom perimeter edge 446 of crown insert 442. In other words, second critical dimension 582 measures the bond gap between bonding wall 454 and bottom perimeter edge 446 of crown insert 442. In some embodiments, second critical dimension 582 may be greater than 0 mm (e.g., due to the presence of adhesive 480 between crown insert 442 and bonding wall 454), but second critical dimension 582 may be no more than a certain value. In some embodiments, second critical dimension 582 of each cross-section is no more than B mm. The value for B may be any value as discussed above for A.

In some embodiments, the average variation of the second critical dimensions 582 between a plurality of cross-sections 550, 552, 554, 556, 558, 560, 562, 564, 566, 568, 570, and 572 (e.g., two or more cross-sections, or three or more cross-sections) is no more than 0.2 mm, 0.15 mm, or 0.1 mm. In some embodiments, the average variation of the second critical dimensions 582 between all the cross-sections is no more than 0.2 mm, 0.15 mm, or 0.1 mm. In some embodiments, the average variation of the second critical dimensions 582 between a plurality of or all the cross-sections located on a front portion of club head 400 is no more than 0.2 mm, 0.15 mm or 0.1 mm. For example, in some embodiments, the average variation of the second critical dimensions 582 between a plurality of or all cross-sections 550, 552, 554, 556, 558 (i.e., first cross-section 550 through fifth cross-section 558) is no more than 0.2 mm, 0.15 mm, or 0.1 mm. In some embodiments, the average variation of the second critical dimensions 582 between a plurality of or all cross-sections 550, 552, 554, 556, 558, 560, and 562 (i.e., first cross-section 550 through seventh cross-section 562) is no more than 0.2 mm, 0.15 mm, or 0.1 mm.

The value for the average variation between the second critical dimensions 582 may be any value as discussed above for the average variation between the first critical dimensions 580. Also, the average variation between the second critical dimensions 582 is calculated in the same fashion as the average variation for the first critical dimensions 580.

As shown for example in FIG. 5B, each cross-section may also have a third critical dimension 584 measured parallel to X-Y plane 512 between bonding wall 454 and a middle point 447 of perimeter wall 444 of crown insert 442. In other words, third critical dimension 584 measures the bond gap between bonding wall 454 and middle point 447 of crown insert 442. In some embodiments, third critical dimension 584 may be greater than 0 mm (e.g., due to the presence of adhesive 480 between crown insert 442 and bonding wall 454), but third critical dimension 584 may be no more than a certain value. In some embodiments, third critical dimension 584 of each cross-section is no more than C mm. The value for C may be any value as discussed above for A.

In some embodiments, the average variation of the third critical dimensions 584 between a plurality of cross-sections 550, 552, 554, 556, 558, 560, 562, 564, 566, 568, 570, and 572 (e.g., two or more cross-sections, or three or more cross-sections) is no more than 0.2 mm, 0.15 mm, or 0.1 mm. In some embodiments, the average variation of the third critical dimensions 584 between all the cross-sections is no more than 0.2 mm, 0.15 mm, or 0.1 mm. In some embodiments, the average variation of the third critical dimensions 584 between a plurality of or all the cross-sections located on a front portion of club head 400 is no more than 0.2 mm, 0.15 mm, or 0.1 mm. For example, in some embodiments, the average variation of the third critical dimensions 584 between a plurality of or all cross-sections 550, 552, 554, 556, 558 (i.e., first cross-section 550 through fifth cross-section 558) is no more than 0.2 mm, 0.15 mm, or 0.1 mm. In some embodiments, the average variation of the third critical dimensions 584 between a plurality of or all cross-sections 550, 552, 554, 556, 558, 560, and 562 (i.e., first cross-section 550 through seventh cross-section 562) is no more than 0.2 mm, 0.15 mm, or 0.1 mm.

The value for the average variation for the third critical dimensions 584 may be any value as discussed above for the average variation for the first critical dimensions 580. Also, the average variation for the third critical dimensions 584 is calculated in the same fashion as the average variation for the first critical dimensions 580.

FIGS. 5A and 5B show a perimeter wall 444 and bonding wall 454 angled toward the center of golf club head 400 (i.e., inwardly angled walls). The angle of perimeter wall 444 and bonding wall 454 may be, for example, 10 degrees. The angle of perimeter wall 444 and bonding wall 454 may vary depending on the desired shape of the junction between perimeter wall 444 and bonding wall 454. Various non-limiting perimeter wall 444 and bonding wall 454 configurations are shown in FIGS. 6A-9B. In other embodiments, FIGS. 5A-9B show a cross-sectional view of a golf club head having a sole insert located in a sole recess. In other words, the bonding walls shown in FIGS. 5A-9B may be bonding walls formed on the sole portion of club head 400, the ledges shown in FIGS. 5A-9B may be sole ledges, and the bonding walls and ledges may define sole recess regions for receiving all or a portion of a bottom surface panel/insert 439.

Figure 6A:
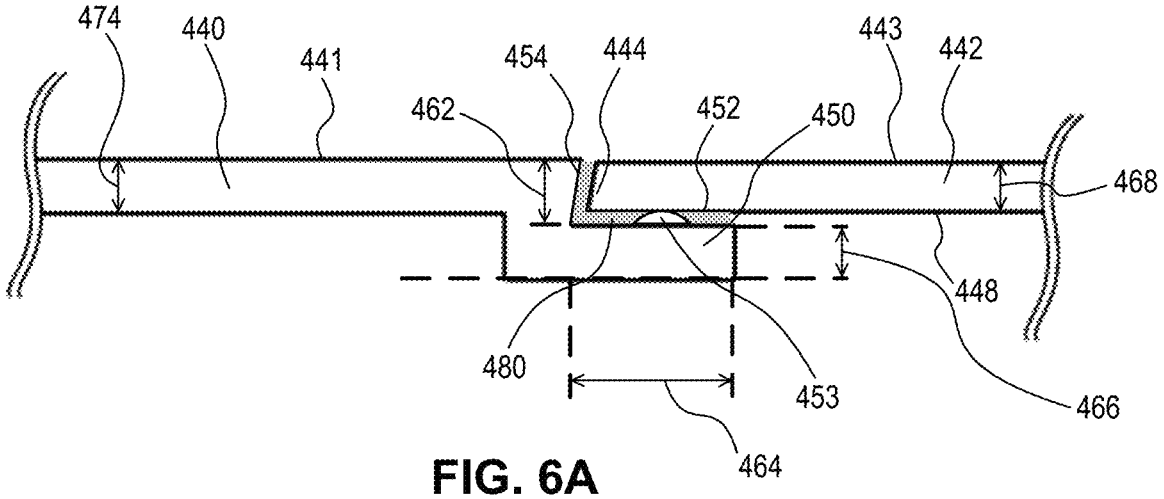
FIG. 6A is a cross-sectional view of a golf club head taken perpendicular to a bonding wall at a critical point according to some embodiments.
Figure 6B:
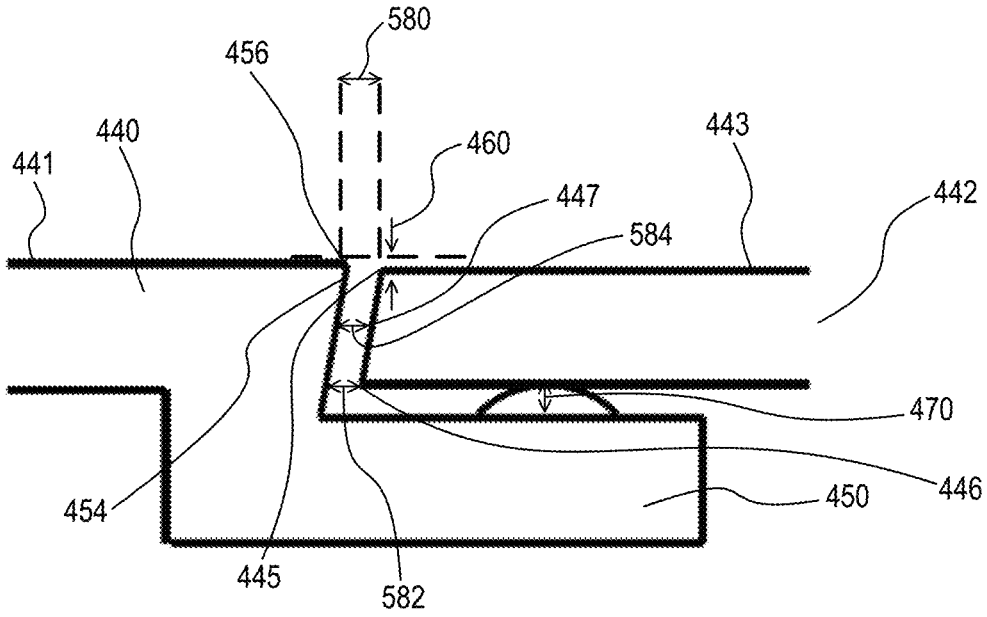
FIG. 6B is an enlarged view of a portion of FIG. 6A.
Figure 7A:
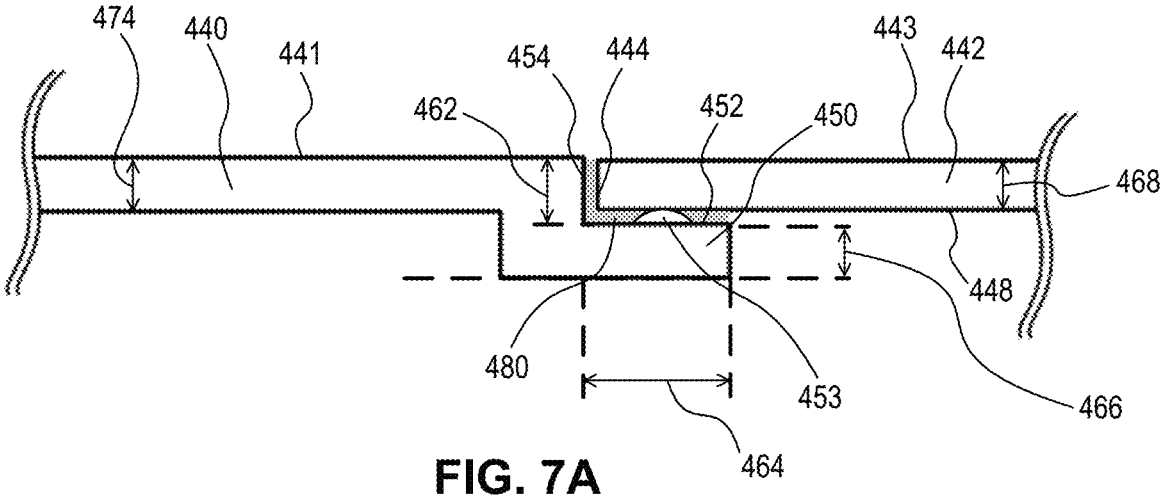
FIG. 7A is a cross-sectional view of a golf club head taken perpendicular to a bonding wall at a critical point according to some embodiments.
Figure 7B:
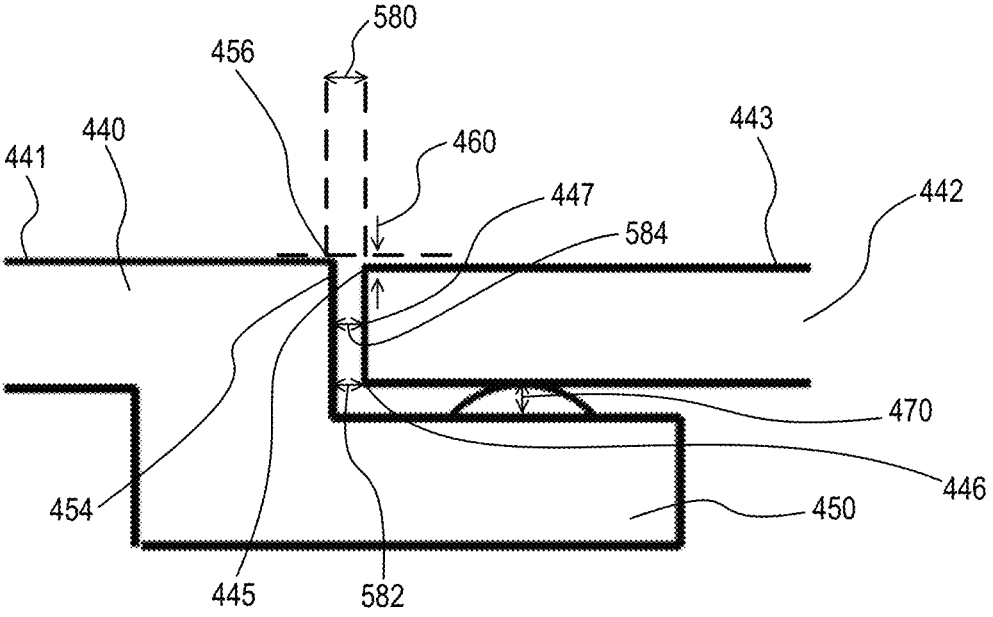
FIG. 7B is an enlarged view of a portion of FIG. 7A.
Figure 8A:
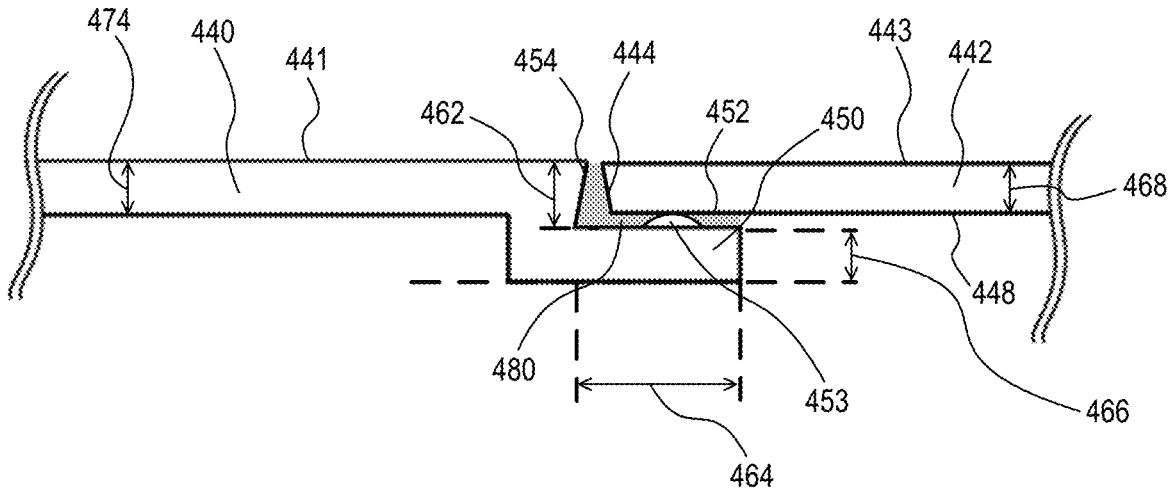
FIG. 8A is a cross-sectional view of a golf club head taken perpendicular to a bonding wall at a critical point according to some embodiments.
Figure 8B:
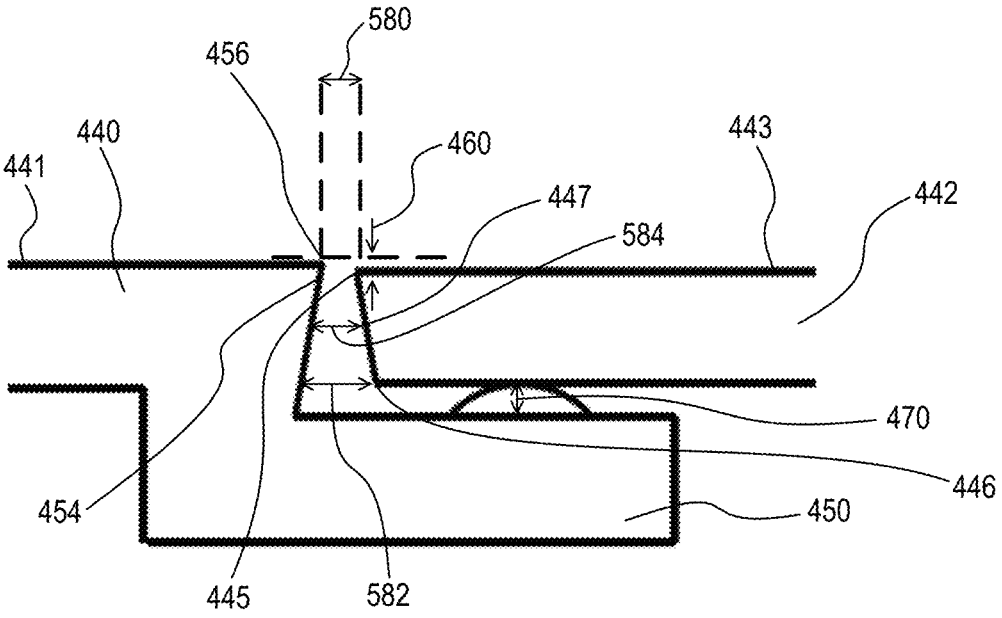
FIG. 8B is an enlarged view of a portion of FIG. 8A.
Figure 9A:
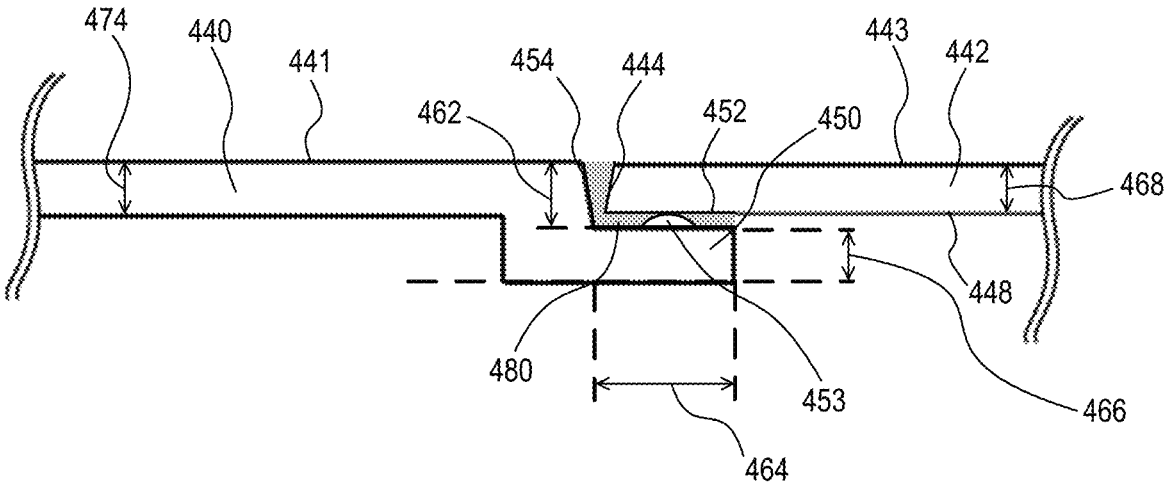
FIG. 9A is a cross-sectional view of a golf club head taken perpendicular to a bonding wall at a critical point according to some embodiments.
Figure 9B:
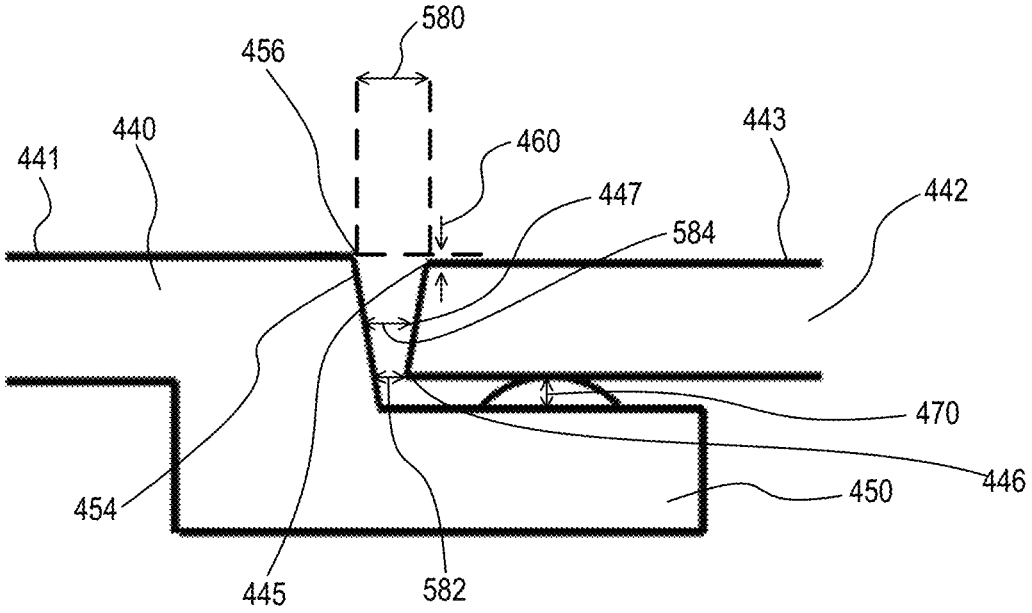
FIG. 9B is an enlarged view of a portion of FIG. 9A.
Figure 10A:
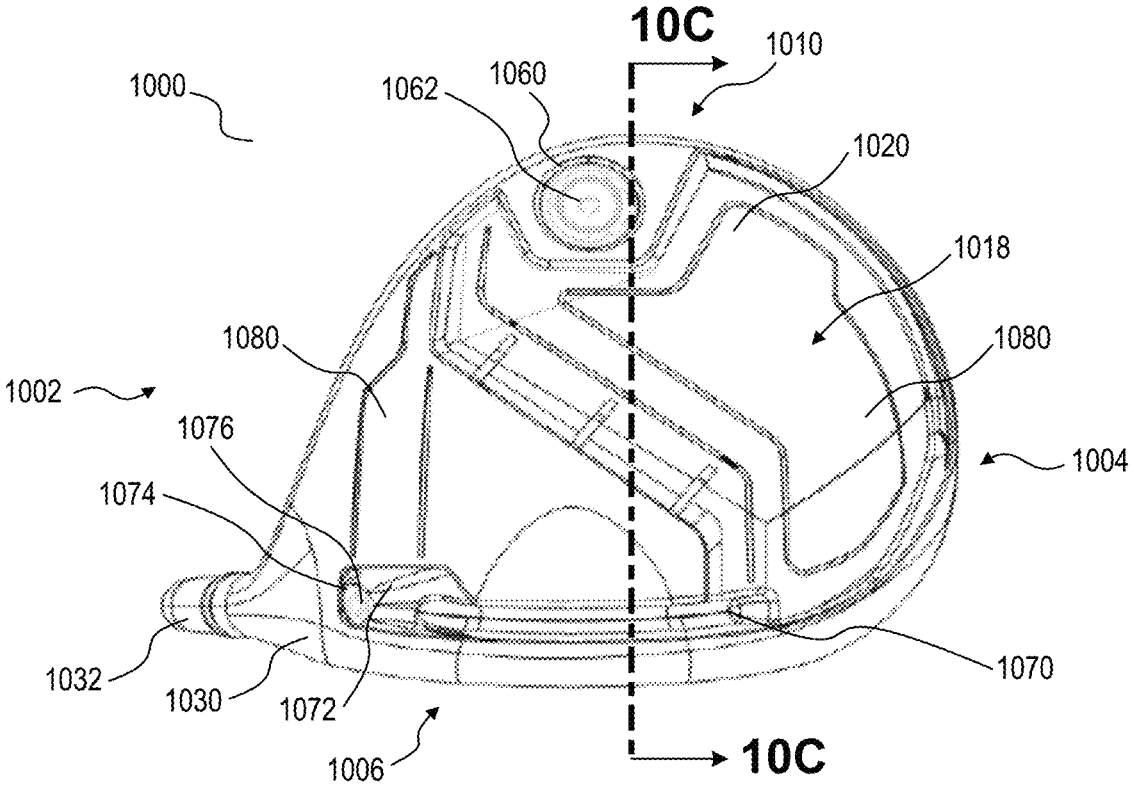
FIG. 10A is a bottom side view of a golf club head according to some embodiments.
Figure 10B:
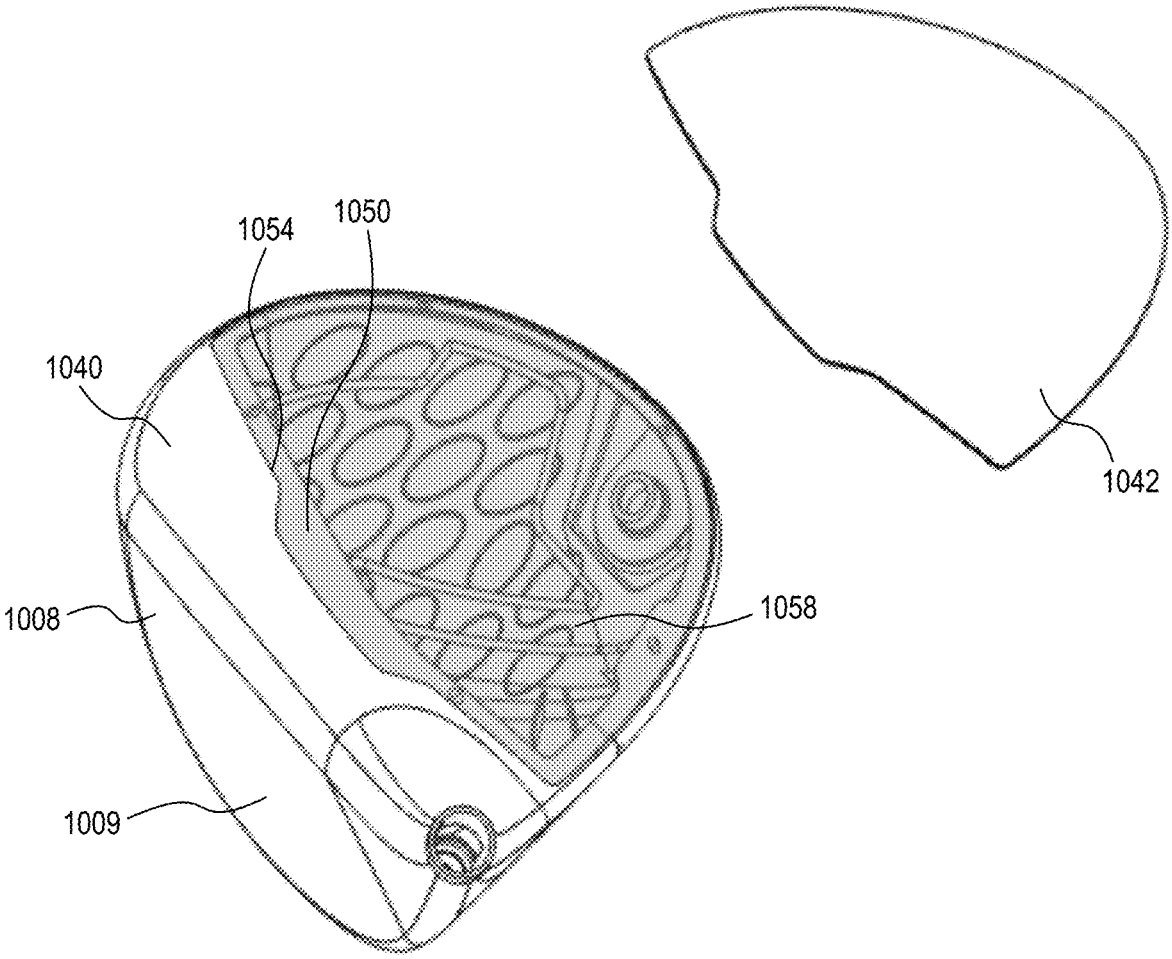
FIG. 10B is a top perspective view of a golf club head and crown insert according to some embodiments.
Figure 10C:
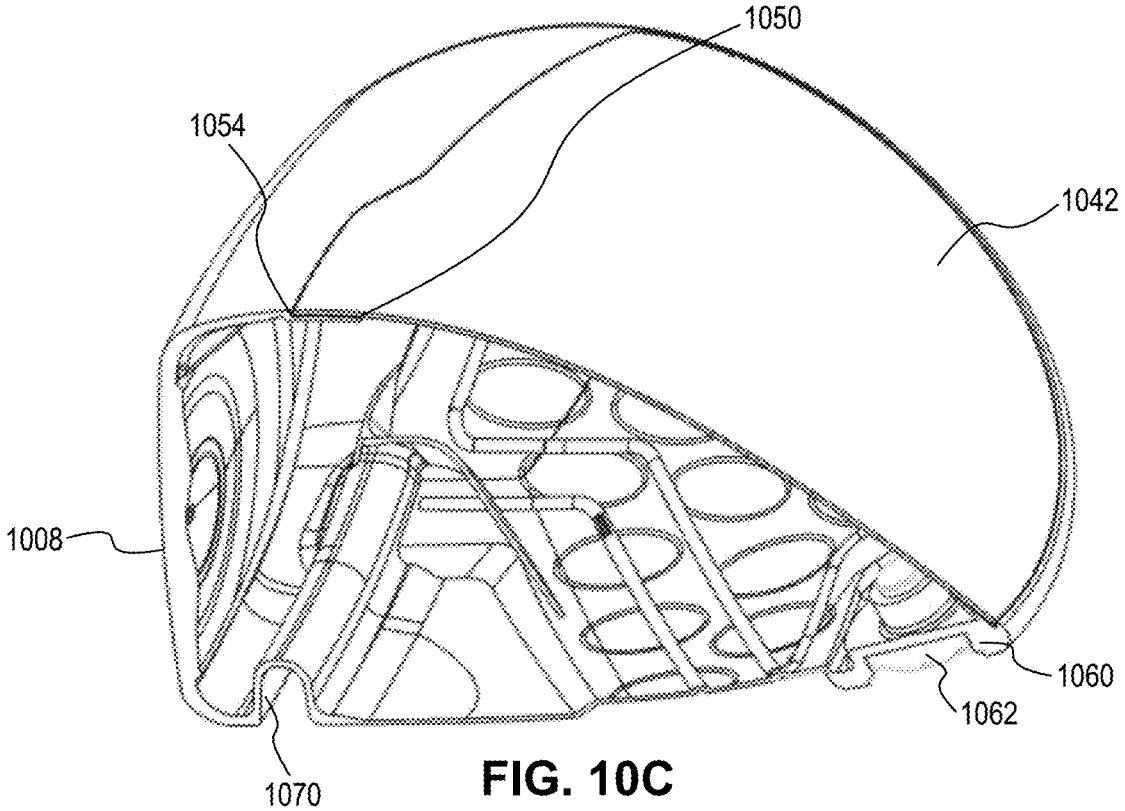
FIG. 10C is a cross-sectional view of a golf club head according to some embodiments taken along section line 10C-10C in FIG. 10A.
Figure 10D:
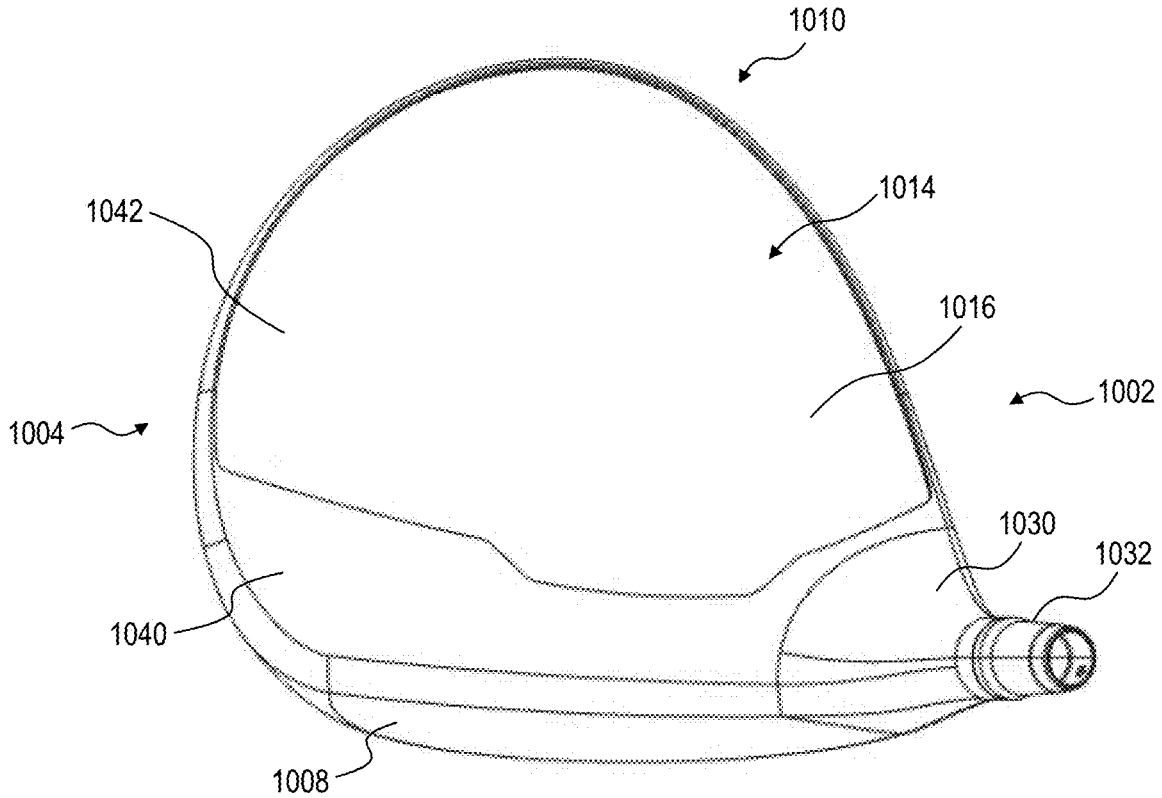
FIG. 10D is a top side view of a golf club head according to some embodiments

FIGS. 6A and 6B show an outwardly angled (i.e., angled towards club face 408 of club head 400) perimeter wall 444 and an outwardly angled bonding wall 454 according to some embodiments. The angle of perimeter wall 444 and bonding wall 454 in FIGS. 6A and 6B may be, for example, 10 degrees. FIGS. 7A and 7B show a vertically straight perimeter wall 444 and a vertically straight bonding wall 454 according to some embodiments. FIGS. 8A and 8B show an inwardly angled perimeter wall 444 and an outwardly angled bonding wall 454 according to some embodiments. FIGS. 9A and 9B show an outwardly angled perimeter wall 444 and an inwardly angled bonding wall 454. The inward and outward angles of perimeter wall 444 and bonding wall 454 in FIGS. 8A-9B may be, for example, 10 degrees.

FIGS. 10A-10D show a golf club head 1000 according to some embodiments. Similar to golf club heads 100/400, golf club head 1000 includes a heel side 1002, a toe side 1004, front side 1006 having a club face 1008 and a striking face 1009, a rear side 1010, a top side 1014 (also called a crown) having top surface 1016, a bottom side 1018 (also called a sole or sole portion) having a bottom surface 1020, a hosel 1030, and a hosel insert 1032. Hosel insert 1032 may be the same as or similar to hosel inserts 158/432. Golf club head 1000 has a width dimension W, a height dimension H, and a depth dimension D that may be the same as or similar to the dimensions discussed above for golf club head 100 and may be measured in the same fashion as described above for golf club head 100.

Top side 1014 (i.e. crown) of club head 1000 may be defined by a crown portion 1040 and a crown insert 1042. Crown portion 440 and crown insert 442 may be the same as or similar to crown portion 1040 and crown insert 1042 discussed herein in regards to club head 400.

Similar to club head 400, club head 1000 may include a crown recess region 1058 (shaded gray in FIG. 10B for illustration purposes) defined by a crown ledge 1050 and a bonding wall 1054. Crown ledge 1050 and bonding wall 1054 may be the same as or similar to crown ledge 450 and bonding wall 454. An adhesive may be used to bond crown insert 1042 to crown ledge 1050 and/or bonding wall 1054 in the same fashion as discussed above for club head 400. Further, the critical dimensions between a perimeter edge (or wall) of crown insert 1042 and bonding wall 1054 may be defined and measured in the same fashion as discussed herein for club head 400.

In some embodiments, golf club head 1000 may be provided with a weight port 1060 and an adjustable weight 1062 located in weight port 1060. Weight port 1060 and adjustable weight 1062 may be the same as or similar to weight port 180 and adjustable weight 182 discussed herein in regards to club head 100.

In some embodiments, golf club head 1000 may include a recessed channel portion 1070 having a channel sidewall 1072 in a front portion of bottom side 1018 of golf club head 1000 proximate to club face 1008. Within channel portion 1070, a fastener opening 1074 may be provided to allow the insertion of a mechanical fastener 1076, such as a screw, for engaging with hosel insert 1032 for attaching a shaft (e.g., club shaft 1104) to golf club head 1000 and/or to allow for an adjustable loft, lie, and/or face angle.

In some embodiments, golf club head 1000 may include one or more bottom surface panels 1080. In some embodiments, bottom surface panels 1080 may be panels comprising a composite material. Bottom surface panels 1080 may be the same as or similar to bottom surface panels 439 discussed herein in regards to club head 400.

Figure 11:
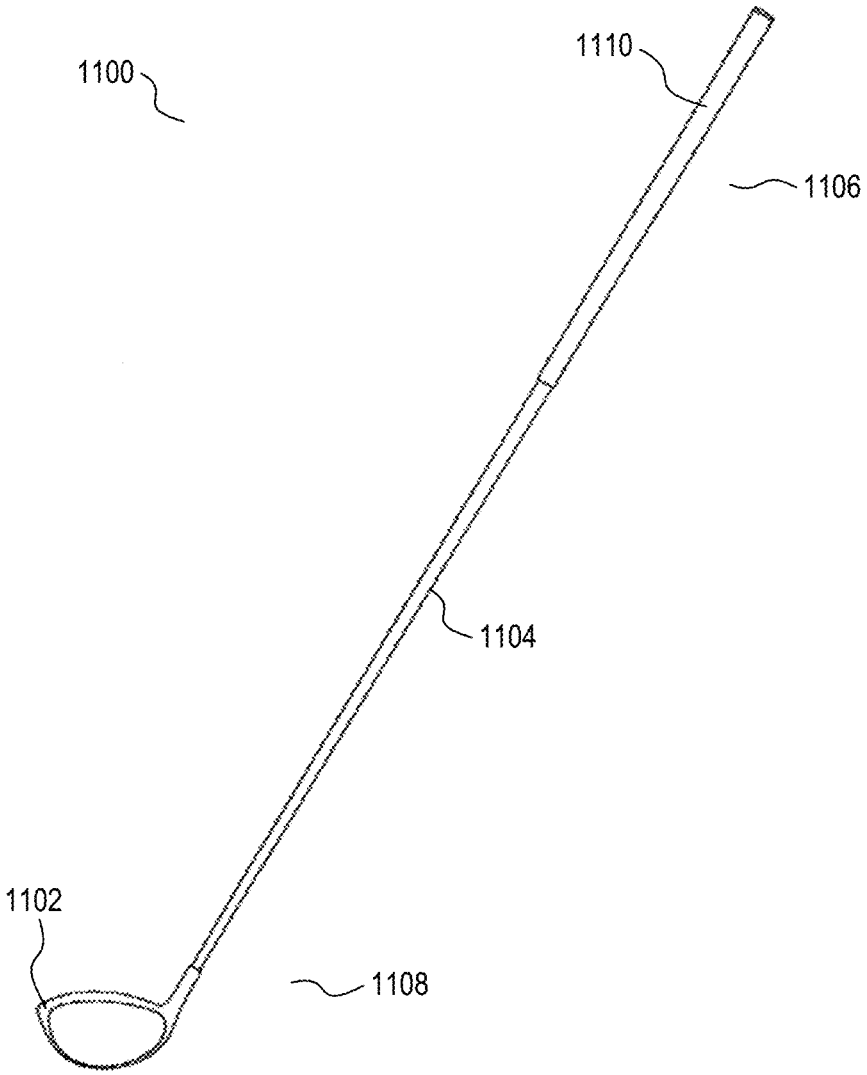
FIG. 11 is a golf club according to some embodiments.

FIG. 11 shows a golf club 1100 according to some embodiments. Golf club 1100 includes a club head 1102 and a club shaft 1104. Club shaft 1104 includes a grip end 1106 and club head end 1108 coupled to a hosel of golf club head 1102. Grip end 1106 may include a grip 1110. Golf club head 1102 may be the same as or similar to any club head discussed herein (e.g., club heads 100, 400, and 1000). In some embodiments, golf club 1100 may include one or more removable shaft mechanisms configured to adjust at least one of a loft, a lie, or a club face angle of golf club head 1102. For example, golf club 1100 may include an adjustable hosel insert configured to adjust at least one of a loft, a lie, or a club face angle of golf club head 1102. In some embodiments, golf club head 1102 may include one or more movable weights configured to slide within recessed channel(s) formed in golf club head 1102.

Figure 12:
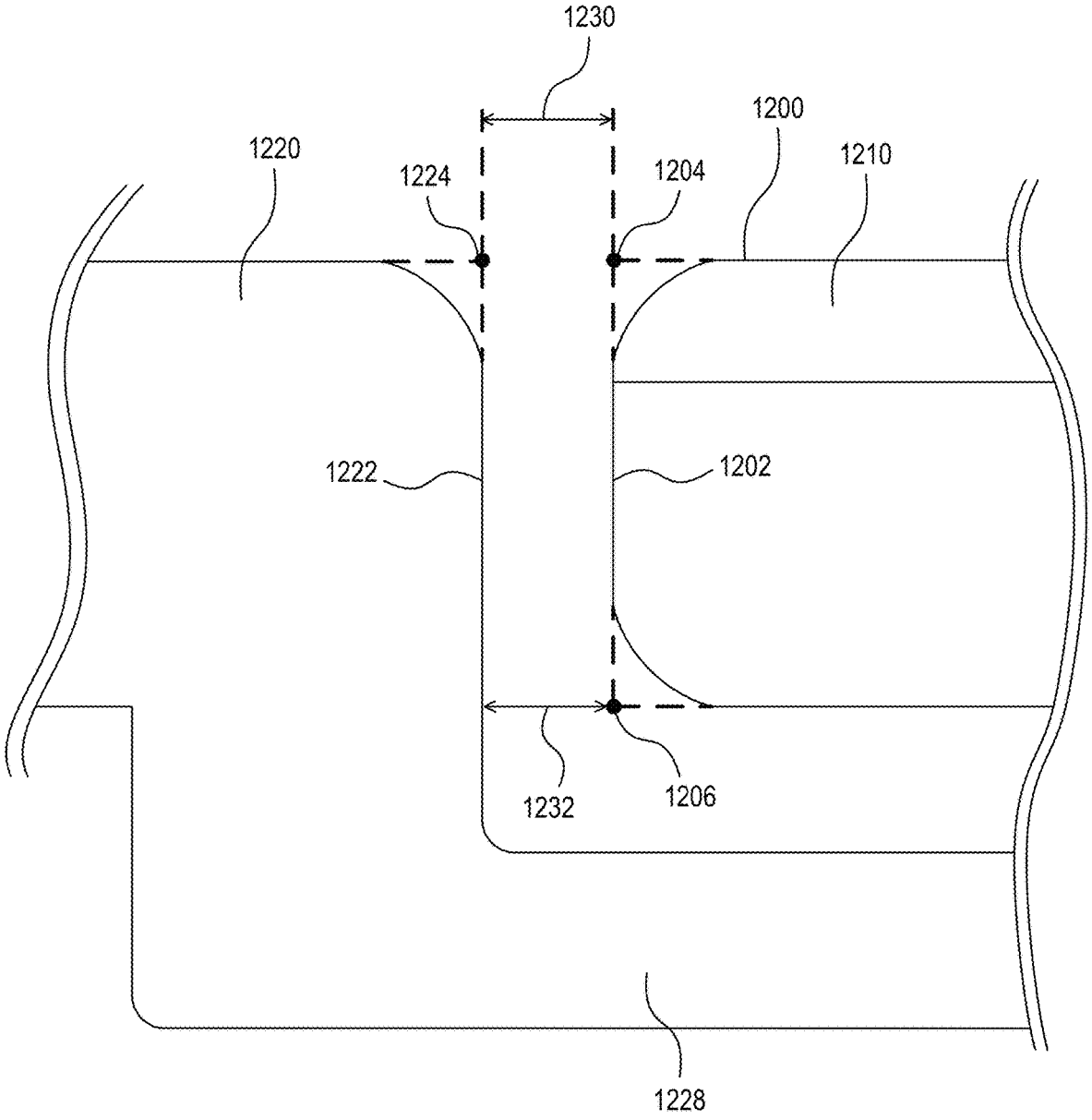
FIG. 12 is a cross-sectional view of a golf club head taken perpendicular to a bonding wall at a critical point according to some embodiments.

FIG. 12 shows a cross-sectional view of a golf club head corresponding to any of cross-sections 550, 552, 554, 556, 558, 560, 562, 564, 566, 568, 570, and 572. FIG. 12 shows a crown insert 1200 having a perimeter wall 1202, a top perimeter edge 1204, and bottom perimeter edge 1206. FIG. 12 also shows a crown portion 1220 having a bonding wall 1222 and a crown ledge 1228.

As shown in FIG. 12, edges of crown insert 1200 and/or bonding wall 1222 may have a substantially rounded shape in some embodiments. A substantially rounded shape is defined as a corner radii that is more than one quarter of the crown or sole insert thickness. For example, a 1 mm thick insert having 0.25 mm radius corner would be considered a substantially rounded shape and therefore utilize the extrapolated method described below. If a substantially rounded shape is not present based on the above definition, then the topmost visible edge would be utilized for measuring the first critical dimension and a bottom most edge would be utilized for measuring the second critical dimension.

In the event that such edges have a substantially rounded shape, FIG. 12 illustrates how to determine the location of the top perimeter edge 1204, the bottom perimeter edge 1206, and a first critical point 1224. Edges 1204 and 1206, and point 1224 are located at the points where crown insert 1200 and bonding wall 1222 would have edges formed at right angles. In other words, the substantially rounded edges of crown insert 1200 and/or bonding wall 1222 are extrapolated to right angle edges to determine the location of top perimeter edge 1204, bottom perimeter edge 1206, and first critical point 1224. After determining the locations of top perimeter edge 1204, bottom perimeter edge 1206, and first critical point 1224, a first critical dimension 1230 and a second critical dimension 1232 can be measured in the same fashion as described for first critical dimension 580 and second critical dimension 582.

In order to determine the critical dimensions (first, second, and third critical dimensions for example) and measurements described above, a section of the crown insert (e.g., composite crown insert) and corresponding bonding wall and structure can be taken from a golf club head and cold mounted in a cylindrical mold using a 2-part epoxy and holding spring clips manufactured by LECO, part 810-485 and a LECO powder liquid resin in a 1:1 ratio. The sample can be polished for high resolution viewing. A high resolution digital microscope having a 200× or more capability should be selected such as a Keyence VHX-700 F Digital Microscope.

In some embodiments, a crown insert (e.g., crown insert 1200) may include a plurality of layers including, for example, an upper layer (e.g., upper layer 1210). In some embodiments, individual layers of a crown or sole insert (e.g., crown inserts 170, 442, 1042, or 1200) may be defined by individual composite plies.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A golf club comprising:

a grip;

a golf club shaft; and a golf club head having:

a sole portion;

a crown portion, the crown portion defining a top surface of the club head and comprising: a crown recess region formed in the crown portion and defined by a crown ledge and a bonding wall, the crown recess region comprising a crown opening and a crown insert disposed at least partially within the crown recess region and covering the crown opening;

a club face;

a width dimension measured along an X-axis from a toe side of the golf club head to a heel side of the golf club head;

a depth dimension measured along a Y-axis from a forward most point of the golf club head to a rearward most point of the golf club head;

a central Z-axis extending in a vertical direction through the crown portion at a midpoint of the width dimension and a midpoint of the depth dimension;

a central Y-axis intersecting the central Z-axis at the top surface of the club head and extending parallel to the Y-axis;

a central X-axis intersecting the central Z-axis at the top surface of the club head and extending parallel to the X-axis;

a first vertical plane defined by the central Z axis and the central Y-axis;

a second vertical plane defined by rotating the first vertical plane 30 degrees clockwise about the central Z-axis;

a third vertical plane defined by rotating the first vertical plane 30 degrees counter-clockwise about the central Z-axis;

a fourth vertical plane defined by the central Z-axis and the central X-axis;

a fifth vertical plane defined by rotating the fourth vertical plane 30 degrees clockwise about the central Z-axis;

a sixth vertical plane defined by rotating the fourth vertical plane 30 degrees counter-clockwise about the central Z-axis;

an X-Y plane defined by the central Y-axis and the central X-axis;

a first critical point located on a front portion of the club head at the intersection between the first vertical plane and a top edge of the bonding wall, and a first cross-section taken on a vertical plane perpendicular to the bonding wall at the first critical point;

a second critical point located on the front portion of the club head at the intersection between the second vertical plane and the top edge of the bonding wall, and a second cross-section taken on a vertical plane perpendicular to the bonding wall at the second critical point;

a third critical point located on the front portion of the club head at the intersection between the third vertical plane and the top edge of the bonding wall, and a third cross-section taken on a vertical plane perpendicular to the bonding wall at the third critical point;

a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point, wherein each cross-section has a first critical dimension defining a bond gap between the crown insert and the bonding wall and measured parallel to the X-Y plane between the top edge of the bonding wall and a top perimeter edge of the crown insert, wherein the first critical dimension of each cross-section is no more than A mm, and wherein the average variation of the first critical dimensions between the five cross-sections is no more than 0.2 mm, wherein the crown ledge comprises a first region having a first length and a second region having a second length, wherein the first length is measured from the bonding wall to the crown opening in a direction parallel to the Y-axis of the club head and the second length is measured from the bonding wall to the crown opening in a direction parallel to the Y-axis of the club head, wherein the first length is greater than the second length, wherein the first region and the second region are located on the front portion of the club head between the fifth vertical plane and the sixth vertical plane, and wherein a tapered step change of a distance to the bonding wall from the club face in a direction parallel to the Y-axis causes the first length to be greater than the second length.

2. The golf club of claim 1, wherein A is 1.0 mm.

3. The golf club of claim 1, wherein the average variation of the first critical dimensions between the five cross-sections is no more than 0.15 mm.

4. The golf club of claim 1, wherein the average variation of the first critical dimensions between the five cross-sections is between 0.1 mm and 0 mm.

5. The golf club of claim 1, wherein the crown insert comprises an upper layer that extends to the top perimeter edge of the crown insert and is visible at the top perimeter edge of the crown insert located in the front portion of the golf club head.

6. The golf club of claim 1, wherein the bond gap is visible and is not covered by a masking layer on a finished product comprising the golf club head.

7. The golf club of claim 1, wherein each cross-section has a second critical dimension measured parallel to the X-Y plane between the bonding wall and a bottom perimeter edge of the crown insert, wherein the second critical dimension of each cross-section is no more than B mm, and wherein the average variation of the second critical dimensions between the five cross-sections is no more than 0.2 mm.

8. The golf club of claim 7, wherein B is 1.0 mm.

9. The golf club of claim 7, wherein the average variation of the second critical dimensions between the five cross-sections is no more than 0.15 mm.

10. The golf club of claim 1, wherein at least a portion of a top surface of the crown insert at the top perimeter edge of the crown insert is disposed below a top surface of the crown portion at the bonding wall.

11. The golf club of claim 10, wherein at least a portion of the top surface of the crown insert at the top perimeter edge of the crown insert is disposed below the top surface of the crown portion at the bonding wall by a vertical distance between 0.1 mm to 0.3 mm.

12. The golf club of claim 1, wherein a hosel portion of the golf club head is configured to receive a sleeve attached to the golf club shaft, the sleeve being capable of being positioned to adjust the loft, lie, or face angle of the golf club head.

13. The golf club of claim 1, wherein the crown ledge comprises a ledge surface defining a ledge gap between the ledge surface and the crown insert, the ledge gap being no more than 0.3 mm.

14. The golf club of claim 1, wherein the thickness of the crown insert is no greater than 1 mm.

15. The golf club of claim 1, wherein the golf club head comprises a movable weight configured to be moved from a first position to a second position in the golf club head.

16. The golf club of claim 1, wherein the bond gap between the crown insert and the bonding wall is continuous and uniform across the entire length of the bond gap between the fifth vertical plane and the sixth vertical plane.

17. A golf club head comprising:

a crown defining the top surface of the club head, the crown comprising:

a crown portion;

a crown recess region formed in the crown portion and defined by a crown ledge and a bonding wall, the crown recess region comprising a crown opening and a crown insert disposed at least partially within the crown recess region and covering the crown opening;

a club face;

a width dimension measured along an X-axis from a toe side of the golf club head to a heel side of the golf club head;

a depth dimension measured along a Y-axis from a forward most point of the golf club head to a rearward most point of the golf club head;

a central Z-axis extending in a vertical direction through the crown at a midpoint of the width dimension and a midpoint of the depth dimension;

a central Y-axis intersecting the central Z-axis at the top surface of the club head and extending parallel to the Y-axis;

a central X-axis intersecting the central Z-axis at the top surface of the club head and extending parallel to the X-axis;

a first vertical plane defined by the central Z axis and the central Y-axis;

a second vertical plane defined by rotating the first vertical plane θ degrees clockwise about the central Z-axis;

a third vertical plane defined by rotating the first vertical plane θ degrees counter-clockwise about the central Z-axis;

a fourth vertical plane defined by the central Z-axis and the central X-axis;

a fifth vertical plane defined by rotating the fourth vertical plane β degrees clockwise about the central Z-axis;

a sixth vertical plane defined by rotating the fourth vertical plane β degrees counter-clockwise about the central Z-axis;

an X-Y plane defined by the central Y-axis and the central X-axis;

a first critical point located on a front portion of the club head at the intersection between the first vertical plane and a top edge of the bonding wall, and a first cross-section taken on a vertical plane perpendicular to the bonding wall at the first critical point;

a second critical point located on the front portion of the club head at the intersection between the second vertical plane and the top edge of the bonding wall, and a second cross-section taken on a vertical plane perpendicular to the bonding wall at the second critical point;

a third critical point located on the front portion of the club head at the intersection between the third vertical plane and the top edge of the bonding wall, and a third cross-section taken on a vertical plane perpendicular to the bonding wall at the third critical point;

a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point, wherein each cross-section has a first critical dimension defining a bond gap between the crown insert and the bonding wall and measured parallel to the X-Y plane between the top edge of the bonding wall and a top perimeter edge of the crown insert, wherein the first critical dimension of each cross-section is no more than 1.0 mm, wherein the average variation of the first critical dimensions between the five cross-sections is no more than 0.15 mm, wherein θ is the range of 1 degree to 45 degrees, and wherein β is the range of 1 degree to 44 degrees, wherein the crown ledge comprises a first region having a first length and a second region having a second length, wherein the first length is measured from the bonding wall to the crown opening in a direction parallel to the Y-axis of the club head and the second length is measured from the bonding wall to the crown opening in a direction parallel to the Y-axis of the club head, wherein the first length is greater than the second length, wherein the first region and the second region are located on the front portion of the club head between the fifth vertical plane and the sixth vertical plane, and wherein a tapered step change of a distance to the bonding wall from the club face in a direction parallel to the Y-axis causes the first length to be greater than the second length.

18. The golf club head of claim 17, wherein θ and β are 30 degrees.

19. A golf club head comprising:

a hosel portion configured to receive a sleeve being capable of being positioned to adjust the loft, lie, or face angle of the golf club head;

a club face;

a crown portion and a sole portion, the crown portion defining a top surface of the club head and comprising: a crown recess region formed in the crown portion and defined by a crown ledge and a bonding wall, the crown recess region comprising a crown opening and a crown insert disposed at least partially within the crown recess region and covering the crown opening;

a width dimension measured along an X-axis from a toe side of the golf club head to a heel side of the golf club head;

a depth dimension measured along a Y-axis from a forward most point of the golf club head to a rearward most point of the golf club head;

a central Z-axis extending in a vertical direction through the crown portion at a midpoint of the width dimension and a midpoint of the depth dimension;

a central Y-axis intersecting the central Z-axis at the top surface of the club head and extending parallel to the Y-axis;

a central X-axis intersecting the central Z-axis at the top surface of the club head and extending parallel to the X-axis;

a first vertical plane defined by the central Z axis and the central Y-axis;

a second vertical plane defined by rotating the first vertical plane 30 degrees clockwise about the central Z-axis;

a third vertical plane defined by rotating the first vertical plane 30 degrees counter-clockwise about the central Z-axis;

a fourth vertical plane defined by the central Z-axis and the central X-axis;

a fifth vertical plane defined by rotating the fourth vertical plane 30 degrees clockwise about the central Z-axis;

a sixth vertical plane defined by rotating the fourth vertical plane 30 degrees counter-clockwise about the central Z-axis;

an X-Y plane defined by the central Y-axis and the central X-axis;

a first critical point located on a front portion of the club head at the intersection between the first vertical plane and a top edge of the bonding wall, and a first cross-section taken on a vertical plane perpendicular to the bonding wall at the first critical point;

a second critical point located on the front portion of the club head at the intersection between the second vertical plane and the top edge of the bonding wall, and a second cross-section taken on a vertical plane perpendicular to the bonding wall at the second critical point;

a third critical point located on the front portion of the club head at the intersection between the third vertical plane and the top edge of the bonding wall, and a third cross-section taken on a vertical plane perpendicular to the bonding wall at the third critical point;

a fourth critical point located on the front portion of the club head at the intersection between the fifth vertical plane and the top edge of the bonding wall, and a fourth cross-section taken on a vertical plane perpendicular to the bonding wall at the fourth critical point; and a fifth critical point located on the front portion of the club head at the intersection between the sixth vertical plane and the top edge of the bonding wall, and a fifth cross-section taken on a vertical plane perpendicular to the bonding wall at the fifth critical point, wherein each cross-section has a first critical dimension defining a bond gap between the crown insert and the bonding wall and measured parallel to the X-Y plane between the top edge of the bonding wall and a top perimeter edge of the crown insert, wherein the first critical dimension of each cross-section is no more than 1.0 mm, and wherein the average variation of the first critical dimensions between the five cross-sections is no more than 0.2 mm, wherein the crown ledge comprises a first region having a first length and a second region having a second length, wherein the first length is measured from the bonding wall to the crown opening in a direction parallel to the Y-axis of the club head and the second length is measured from the bonding wall to the crown opening in a direction parallel to the Y-axis of the club head, wherein the first length is greater than the second length, wherein the first region and the second region are located on the front portion of the club head between the fifth vertical plane and the sixth vertical plane, and wherein a tapered step change of a distance to the bonding wall from the club face in a direction parallel to the Y-axis causes the first length to be greater than the second length.

20. The golf club head of claim 19, wherein the average variation of the first critical dimensions between the five cross-sections is no more than 0.15 mm.

* * * * *